US009818519B2

(12) United States Patent
Miyamura et al.

(10) Patent No.: US 9,818,519 B2
(45) Date of Patent: Nov. 14, 2017

(54) SOFT MAGNETIC MIXED POWDER

(71) Applicant: Kabushiki Kaisha Kobe Seiko Sho (Kobe Steel, Ltd.), Kobe-shi (JP)

(72) Inventors: Takeo Miyamura, Kobe (JP); Hiroyuki Mitani, Kobe (JP)

(73) Assignee: Kabushiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 455 days.

(21) Appl. No.: 14/431,480

(22) PCT Filed: Sep. 19, 2013

(86) PCT No.: PCT/JP2013/075328

§ 371 (c)(1),
(2) Date: Mar. 26, 2015

(87) PCT Pub. No.: WO2014/054430

PCT Pub. Date: Apr. 10, 2014

(65) Prior Publication Data

US 2015/0243420 A1 Aug. 27, 2015

(30) Foreign Application Priority Data

Oct. 3, 2012 (JP) ..... 2012-221698
Feb. 21, 2013 (JP) ..... 2013-032625

(51) Int. Cl.
*H01F 1/12* (2006.01)
*H01F 1/147* (2006.01)
(Continued)

(52) U.S. Cl.
CPC ..... *H01F 1/14791* (2013.01); *B22F 1/0014* (2013.01); *B22F 1/0062* (2013.01);
(Continued)

(58) Field of Classification Search
None
See application file for complete search history.

(56) References Cited

U.S. PATENT DOCUMENTS 8,518,190 B2 * 8/2013 Liao ..... H01F 17/04 148/105
2004/0086708 A1 * 5/2004 Verma ..... H01F 1/1475 428/329

(Continued)

FOREIGN PATENT DOCUMENTS

CN 102473517 A 5/2012
JP 6 236808 8/1994

(Continued)

OTHER PUBLICATIONS

Written Opinion of the International Searching Authority and International Search Report dated Nov. 12, 2013 in PCT/JP2013/075328 Filed Sep. 19, 2013.

*Primary Examiner* — Jessee Roe
*Assistant Examiner* — Ngoclan T Mai
(74) *Attorney, Agent, or Firm* — Oblon, McClelland, Maier & Neustadt, L.L.P.

(57) ABSTRACT

Provided is soft magnetic powder used to manufacture a dust core having good mechanical strength and superior formability while iron loss is reduced. The soft magnetic powder for dust cores according to the invention is soft magnetic mixed powder that includes pure iron powder and soft magnetic iron-base alloy powder, wherein the proportion of the soft magnetic iron-base alloy powder in the mixture is 5 to 60 mass %, the ratio of the modes of the particle size distributions of the soft magnetic iron-base alloy powder and the pure iron powder ((the mode of the particle size distribution of the soft magnetic iron-base alloy powder)/(the mode of the particle size distribution of the pure iron powder)) is 0.9 or more and less than 5, and the ratio
(Continued)

$R_{over}/R_{under}$ is 1.2 or more, where $R_{over}$ is the mass proportion of soft magnetic iron-base alloy powder in mixed powder with a particle size of D50 or more based on the mass fraction, and $R_{under}$ is the mass proportion of soft magnetic iron-base alloy powder in mixed powder with a particle size of less than D50 based on the mass fraction.

11 Claims, 16 Drawing Sheets

(51) Int. Cl.

| | |
|---|---|
| ***H01F 1/20*** | (2006.01) |
| ***H01F 1/22*** | (2006.01) |
| ***C22C 38/02*** | (2006.01) |
| ***C22C 38/06*** | (2006.01) |
| ***B22F 1/00*** | (2006.01) |
| ***C22C 33/02*** | (2006.01) |
| ***B22F 1/02*** | (2006.01) |

(52) U.S. Cl.
CPC ..... *B22F 1/02* (2013.01); *C22C 33/02* (2013.01); *C22C 38/02* (2013.01); *C22C 38/06* (2013.01); *H01F 1/20* (2013.01); *H01F 1/22* (2013.01); *C22C 2202/02* (2013.01)

(56) References Cited

U.S. PATENT DOCUMENTS

| | | | | |
|---|---|---|---|---|
| 2009/0226751 | A1* | 9/2009 | Mitani ..... | B22F 1/0007 428/552 |
| 2012/0119134 | A1 | 5/2012 | Muramatsu et al. | |
| 2013/0015939 | A1* | 1/2013 | Inagaki ..... | B22F 1/02 336/233 |

FOREIGN PATENT DOCUMENTS

| | | |
|---|---|---|
| JP | 8 236331 | 9/1996 |
| JP | 2654944 | 9/1997 |
| JP | 2000 114022 | 4/2000 |
| JP | 2001 196216 | 7/2001 |
| JP | 2007 12745 | 1/2007 |
| JP | 4586399 | 11/2010 |
| WO | 2011 010561 | 1/2011 |
| WO | 2012 128037 | 9/2012 |

* cited by examiner $$\frac{R_{over}}{R_{under}} = \frac{\left(\frac{D}{C+D}\right)}{\left(\frac{B}{A+B}\right)}$$

$$\frac{R_{over}}{R_{under}} = \frac{\left(\frac{D}{C+D}\right)}{\left(\frac{B}{A+B}\right)}$$

SENDUST POWDER MADE BY GAS ATOMIZE METHOD

SENDUST POWDER MADE BY GRINDING METHOD

PURE IRON POWDER BY WATER ATOMIZE METHOD

SOFT MAGNETIC MIXED POWDER

TECHNICAL FIELD

The present invention relates to a soft magnetic mixed powder. According to the soft magnetic mixed powder of the present invention, a powder magnetic core superior in formability while reducing the iron loss and having excellent mechanical strength is provided.

BACKGROUND ART

Electromagnetic components such as a motor, or inductors such as a choke coil, reactor and the like have a structural unit in which a coil of an electric conductor is formed around a magnetic core. For the magnetic core, soft magnetic materials of various shapes such as a plate shape, foil shape, powder shape and so on are used. Among them, the soft magnetic materials of a plate shape and foil shape are used as a laminated magnetic core. Because the laminated magnetic core is obtained by laminating the soft magnetic material of a plate shape or a foil shape, the shape of the laminated magnetic core is limited to two-dimensional shape, and the orientation of the magnetic flux is also limited to the direction parallel to the plate surface or the foil surface.

On the other hand, because the powder magnetic core obtained by forming work of the soft magnetic powder can be formed into optional shapes by changing the mold shape, the shape of the powder magnetic core can be designed three-dimensionally. Also, because the powder magnetic core has no directionality of the magnetic flux which the laminated magnetic core has, magnetic characteristic is isotropic, and three-dimensional design of the magnetic circuit becomes possible. Because the orientation of the magnetic flux largely affects the characteristics such as the torque in electromagnetic components such as motors, when three-dimensional magnetic circuit is achieved using the powder magnetic core, the characteristics of the electromagnetic components can possibly be improved by the effect of the shape of the magnetic core, and the motor and the like using the magnetic core have been watched in recent years.

Because the electromagnetic components such as a motor and inductor are often used in the AC magnetic field, when the powder magnetic core is used for a motor, inductor and the like, from the viewpoint of improving the electromagnetic conversion characteristic, reduction of the iron loss is required.

The iron loss is defined as the energy loss inside a magnetic body caused when the AC magnetic field is applied to the inside of a ferromagnetic body. In the inside of the material and in the region where the relaxing phenomenon of the magnetic flux change (magnetic resonance and the like) does not accompany, the iron loss is expressed by the sum of the hysteresis loss and the eddy current loss. The hysteresis loss is the minimum energy required for changing the magnetic field orientation inside the material, and, as the coercive force that is a threshold value of the magnetic field change is smaller, the value of the hysteresis loss is reduced. The eddy current loss is the joule loss of the induction current accompanying the electromotive force generated by the electromagnetic induction with respect to the magnetic field change, and, as the electric resistance of the material is smaller, the eddy current loss is reduced. Also, when a structural unit formed of the independent soft magnetic material further exists inside the material like a powder magnetic core, the eddy current is generated in the inside of each structural unit also, and, as the structural unit is smaller, the eddy current loss derived from the eddy current inside the structural unit is reduced.

In order to reduce the iron loss, there is a case where the powder magnetic core is manufactured by mixing the powder of the soft magnetic materials of two kinds or more including soft magnetic material having low coercive force. As the combination of the soft magnetic materials of two kinds or more, pure iron, Fe-3% Si alloy, Fe-6.5% Si alloy, Sendust®, amorphous alloy, and the like can be cited, and the mixture of these soft magnetic materials of two kinds or more is used as a magnetic core material. Among them, Sendust is a designation of an Fe-9.5% Si-5.5% Al alloy, is high in magnetic permeability and low in coercive force compared to general soft magnetic materials such as pure iron and the like, is therefore excellent particularly in AC magnetic characteristics in high frequency, and is suitable for the magnetic core material for high frequency. However, because Sendust is of a peculiar crystal structure, Sendust has a defect of being very hard and brittle material, powder compacting of the Sendust powder as a pure iron powder is done is difficult, and the Sendust powder is usually used so as to be dispersed into a resin in general. Although powder compacting of the Sendust powder is not impossible, because very high forming pressure is required, there are problems that the life of the forming mold is shortened and so on. Further, with respect to the magnetic core material for high frequency, although there are also an amorphous alloy (including microcrystal), permalloy, and the like, the amorphous alloy is a material higher in the hardness and harder in forming compared to Sendust, and permalloy contains much of Ni that is an expensive metal and is therefore significantly inferior to the pure iron, Si alloy powder and the Sendust powder in terms of the cost.

On the other hand, as prior arts, there are technologies that any two kinds or more of general soft magnetic powder such as the pure iron powder, Si alloy powder, amorphous alloy powder, Sendust powder and the like are mixed with each other, and the magnetic characteristic and formability are improved. For example, in Patent Literature 1, it is described that, when the amorphous soft magnetic alloy powder and the soft magnetic alloy powder (crystalline material such as Sendust and the like) are mixed with each other at a specific ratio with such grain size that the mode of the grain size distribution differs from each other by 5 time or more, the forming pressure is reduced, and the maximum magnetic flux density and the iron loss can be improved. Patent Literature 2 is an invention on mixing of pure iron and either of Sendust or permalloy. Patent Literature 3 is an invention of mixing of high compressive soft magnetic metal powder (pure iron powder or Fe-3% Si alloy powder) and ferro-alloy powder (Fe-9.5% Si alloy powder or Sendust powder), or mixing of them and soft ferrite. Patent Literature 4 is an invention on mixing of Sendust and highly expansible metal powder (pure iron powder, molybdenum-permally powder, Fe—Si alloy powder).

CITATION LIST

Patent Literature

Patent Literature 1 JP-A No. 2001-196216
Patent Literature 2 Japanese Patent No. 4586399
Patent Literature 3 JP-A No. Hei 6-236808
Patent Literature 4 JP-A No. 2654944

SUMMARY OF INVENTION

Technical Problem

However, there were cases that, even when the powder magnetic core was manufactured by mixing the powders of the soft magnetic materials of two kinds or more including soft magnetic materials with low coercive force with each other, sufficient formability, mechanical strength, and iron loss could not be obtained.

In Patent Literature 1, because formability is inferior and the density of the formed body (space factor) is low, there is a problem that the strength of the formed body is low. Further, in Patent Literature 1, although it is prescribed that the modes of the grain size distribution of two kinds of powder A, B to be mixed are different from each other by 5 times or more, such problem possibly occurs that, when such powder with large grain size difference is filled in a sack or container, only fine particles shift to the bottom, and so on.

Further, in manufacturing the powder magnetic core, in the crystalline powder such as the Sendust, pure iron powder and the like, although the magnetic characteristics do not sufficiently improve unless stress removing annealing of 400° C. or above is executed after powder compacting, when the amorphous powder is subjected to high temperature heat treatment of approximately 600° C., there is a case where the amorphous powder is crystallized and the crystal grains are coarsened. Therefore, there is also a problem peculiar to the amorphous/crystalline powder mixture that the heat treatment temperature cannot be raised sufficiently and the effect of improving the strength by heat treatment cannot be secured.

Also, in Patent Literatures 2-4, there is a problem that the strength of the formed body is low, or the iron loss cannot be reduced sufficiently.

The present invention has been developed in view of such circumstances, and its object is to provide a soft magnetic mixed powder used for a powder magnetic core superior in formability while reducing the iron loss and having excellent mechanical strength in the mixed powder obtained by mixing the soft magnetic alloy powder with the pure iron powder that is inexpensive.

Solution to Problems

The soft magnetic mixed powder related to the present invention which could solve the problems described above is a soft magnetic mixed powder including soft magnetic iron-based alloy powder and pure iron powder in which the mixing rate of the soft magnetic iron-based alloy powder is 5 mass % or more and 60 mass % or less, the ratio of the mode of the grain size of the soft magnetic iron-based alloy powder and the pure iron powder (the mode of the grain size of the soft magnetic iron-based alloy powder/the mode of the grain size of the pure iron powder) is 0.9 or more and less than 5, and the ratio of the mass rate $R_{over}$ of the soft magnetic iron-based alloy powder in the soft magnetic mixed powder with the grain size of cumulative 50% mass average grain size D50 or more of the soft magnetic mixed powder and the mass rate $R_{under}$ of the soft magnetic iron-based alloy powder in the soft magnetic mixed powder with the grain size of less than the D50 ($R_{over}/R_{under}$) is 1.2 or more.

Also, it is preferable that the cumulative 50% mass average grain size D50 of the soft magnetic iron-based mixed powder is 45 μm or more.

It is preferable that the soft magnetic iron-based alloy powder contains Fe and 1 mass % or more and less than 19 mass % of Si. Also, it is preferable that the soft magnetic iron-based alloy powder further contains 1 mass % or more and less than 35 mass % of Al. It is preferable that the soft magnetic iron-based alloy powder is either an alloy powder containing Fe, 1 mass % or more and 35 mass % or less of Al, and 1 mass % or more and 19 mass % or less of Si, or an alloy powder containing Fe and 1 mass % or more and 19 mass % or less of Si.

It is preferable that the soft magnetic mixed powder has an insulation layer. Also, it is preferable that lubricant formed of organic substance is provided on the surface or in the insulation layer of the soft magnetic mixed powder, and it is preferable that lubricant formed of organic substance is provided on the surface or in the insulation layer at least of the soft magnetic iron-based alloy powder. It is preferable that the content of the lubricant is 0.1 mass % or more and 0.6 mass % or less relative to the soft magnetic mixed powder.

In the present invention, a powder magnetic core obtained by using the soft magnetic mixed powder of the present invention is also included.

Advantageous Effects of Invention

The soft magnetic powder of the present invention is a soft magnetic mixed powder including pure iron powder and soft magnetic iron-based alloy powder in which the mixing rate of the soft magnetic iron-based alloy powder is 5 mass % or more and 60 mass % or less, the ratio of the mode of the grain size of the soft magnetic iron-based alloy powder and the pure iron powder (the mode of the grain size of the soft magnetic iron-based alloy powder/the mode of the grain size of the pure iron powder) is 0.9 or more and less than 5, the ratio of the mass rate $R_{over}$ of the soft magnetic iron-based alloy powder in the soft magnetic mixed powder with the grain size of cumulative 50% mass average grain size D50 or more and the mass rate $R_{under}$ of the soft magnetic iron-based alloy powder in the soft magnetic mixed powder with the grain size of less than the cumulative 50% mass average grain size D50 ($R_{over}/R_{under}$) is 1.2 or more, and therefore, according to the soft magnetic mixed powder of the present invention, a powder magnetic core superior in formability while reducing the iron loss and having excellent mechanical strength is obtained.

Also, because the soft magnetic mixed powder in which the soft magnetic alloy powder and the pure iron powder are mixed with each other has powders with different hardness in the powder, the soft powder deforms preferentially rather than the hard powder, and the soft powder positioned around the hard powder in particular is subjected to a high strain. From such viewpoint, addition of lubricant to the mixed powder and the change in compressibility were studied, and it was known that, by provision of the lubricant formed of organic substance on the surface or in the insulation layer of the soft magnetic mixed powder of the present invention, compressibility in forming work could be improved, and the density of the formed body could be further improved. Such effect of improving the compressibility is obtained by reducing excessive friction generated around the soft magnetic iron-based alloy powder that is hardly deformed. Also, in the soft magnetic mixed powder, it is important that the lubricant formed of organic substance is provided on the surface or in the insulation layer at least of the soft magnetic iron-based alloy powder. Further, when the mass rate of the lubricant is 0.1 mass % or more and 0.6 mass % or less relative to 100 mass % of the soft magnetic mixed powder, the compressibility in forming work and the density of the formed body are improved further more.

DESCRIPTION OF EMBODIMENTS

Figure 1:
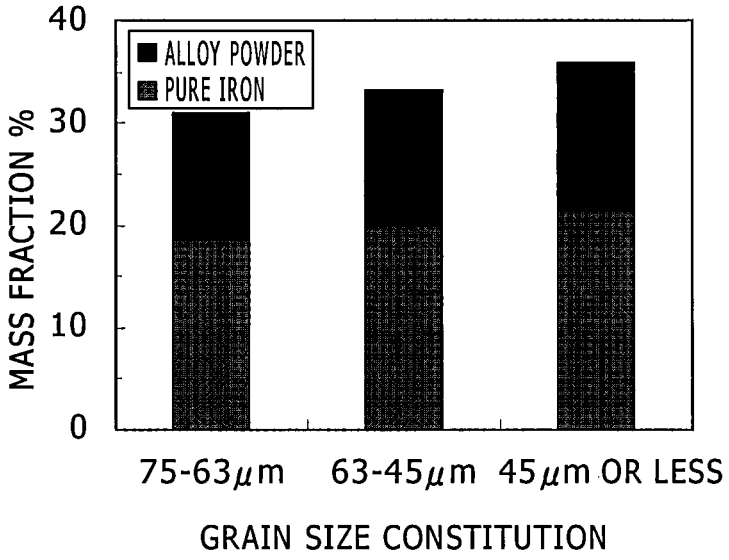
FIG. 1 shows an example of a grain size constitution of a case where the pure iron powder and the soft magnetic iron-based alloy powder are equally mixed with each other in each grain size.

In the present invention, in order to improve the iron loss, formability, and mechanical strength, the relationship of the grain size constitution of the powder of two kinds to be mixed and the characteristics was examined. As a result, it was found out that, when the mixing rate of the soft magnetic iron-based alloy powder out of the soft magnetic mixed powder in which the soft magnetic iron-based alloy powder was mixed with the pure iron powder was made 5 mass % or more and 60 mass % or less, the ratio of the mode of the grain size of the soft magnetic iron-based alloy powder and the pure iron powder (the mode of the grain size of the soft magnetic iron-based alloy powder/the mode of the grain size of the pure iron powder) was made 0.9 or more and less than 5, and the ratio of the mass rate $R_{over}$ of the soft magnetic iron-based alloy powder in the soft magnetic mixed powder with the grain size of cumulative 50% mass average grain size D50 or more of the soft magnetic mixed powder and the mass rate $R_{under}$ of the soft magnetic iron-based alloy powder in the soft magnetic mixed powder with the grain size of less than the D50 ($R_{over}/R_{under}$) was made 1.2 or more, the iron loss, formability, and mechanical strength improved.

In other words, the present invention is important in that the grain size of the alloy powder is relatively coarse and that such grain size constitution that the grain size of the pure iron powder becomes relatively fine is achieved, and reduced iron loss and excellent formability and mechanical strength can be obtained by achieving such grain size.

According to the prior art of mixing the soft magnetic alloy powder with the pure iron powder, the material having both of excellent formability of the pure iron powder and excellent magnetic characteristics in high frequency of the soft magnetic alloy powder was provided, however the effect thereof could not be maximized. In order to reduce the iron loss that is a kind of the magnetic characteristics in high frequency, it is important to reduce either one or both of the eddy current loss and the hysteresis loss constituting the iron loss. With respect to the eddy current loss, because the soft magnetic iron-based alloy powder has electric resistance higher than that of the pure iron powder, when the grain size of the soft magnetic iron-based alloy powder is made relatively coarse as the present invention, even coarse grains can effectively suppress the eddy current loss. Also, because the eddy current loss is proportionate to the second order of the magnitude of the structural unit (for example the size of the powder), when the pure iron powder is made relatively fine particles, the eddy current loss can be suppressed further. Also, with respect to the hysteresis loss, because soft pure iron powder has been made to have fine grain size, by deformation of the pure iron powder, the gap of the soft magnetic iron-based alloy powder which is high in hardness and hardly deformed can be effectively filled. Thus, the hysteresis loss of the formed body can be reduced. Further, the formability improves, the density of the formed body improves, and as a result, reduction of the iron loss (the sum of the eddy current loss and the hysteresis loss) and improvement of the mechanical strength can be achieved.

It is known that, in general, the powder in which coarse powder and fine powder are equally mixed with each other is superior in formability compared to the powder having a single grain size, and the reason thereof is understood to be a principle that fine particles fill the gap between coarse particles. For example, the filling factor is regarded to become the highest when the grain size ratio of the grain size of the coarse particles and the grain size of the fine particles is 7:1 (Hideshi Miura, "Funmatsu Yakin-no Kagaku" (Powder Metallurgy Science), Uchida Rohokaku). Also, in general, the insulation layer exists on the surface of the soft magnetic powder for AC, and the eddy current loss is thereby limited to those derived from the eddy current flowing within the particle. Accordingly, the prior knowledge that the eddy current loss can be reduced by refining the grain size of entire powder exists.

In the soft magnetic mixed powder of the present invention, even when the entire grain size constitution after mixing is the same, by making the ($R_{over}/R_{under}$) ratio within a predetermined range, the magnetic characteristics and the mechanical characteristics of the powder magnetic core obtained can be improved. Therefore, as it is observed in the powder formed of one kind of the soft magnetic material, the magnetic characteristics are not improved by a simple particle size, nor the mechanical characteristics are improved by a simple ideal filling ratio (7:1). The magnetic characteristics improvement effect and the mechanical characteristics improvement effect of the present information are effects peculiar to a case where powders of two kinds having a predetermined grain size constitution are mixed with each other, and the present invention and the prior art described above are intrinsically different from each other.

Below, the present invention will be described in detail.

1. Soft Magnetic Mixed Powder

The soft magnetic mixed powder of the present invention includes the pure iron powder and the soft magnetic iron-based alloy powder. The mixing rate of the soft magnetic iron-based alloy powder is 5 mass % or more and 60 mass % or less with respect to the total amount of the soft magnetic mixed powder. When the mixing rate of the soft magnetic iron-based alloy powder is less than 5 mass %, the reduction effect of the iron loss by mixing cannot be secured, and when the mixing rate of the soft magnetic iron-based alloy powder exceeds 60 mass %, the effect saturates, drop of the formed body density becomes substantial, and the maximum magnetic flux density lowers. From the viewpoint of the reduction effect of the iron loss, the mixing rate of the soft magnetic iron-based alloy powder is preferably 10 mass % or more, and particularly preferably 25 mass % or more. Also, when the mixing rate of the soft magnetic iron-based alloy powder is excessively high, the reduction effect of the iron loss saturates, the density of the formed body is liable to drop simultaneously, and, as a result, the maximum magnetic flux density lowers. Therefore, the mixing rate of the soft magnetic iron-based alloy powder in the soft magnetic mixed powder is preferably 50 mass % or less, and particularly preferably 45 mass % or less.

In the soft magnetic mixed powder of the present invention, the ratio of the mode of the grain size of the soft magnetic iron-based alloy powder and the pure iron powder (the mode of the soft magnetic iron-based alloy powder/the mode of the grain size of the pure iron powder) is 0.9 or more and less than 5. When the ratio of the mode is less than 5, the segregation of the soft magnetic mixed powder is suppressed and the powder magnetic core having stable property is obtained which is therefore preferable. The ratio of the mode is preferably 4.5 or less, and more preferably 3 or less. Also, when the ratio of the mode becomes excessively small, the iron loss increases and the strength and the magnetic flux density reduce which therefore is not preferable. Accordingly, the ratio of the mode (the mode of the soft magnetic iron-based alloy powder/the mode of the grain size of the pure iron powder) is 0.9 or more, preferably 1.0 or more, and more preferably 1.1 or more.

In the present invention, the mode of the grain size is defined as the grain size showing the highest mass fraction in the grain size distribution. When there is a width in each grain size, the mode of the grain size is defined as the median of the grain size that shows the highest mass fraction.

In the present invention, the grain size distribution can be measured by screening for example. In measuring the grain size distribution by screening, when the soft magnetic mixed powder is screened with sieves of different mesh, the soft magnetic mixed powder passing a sieve of a mesh (x) and not passing sieve of a mesh smaller by one stage (x-1) is made the soft magnetic mixed powder of the grain size (x). The grain size distribution on number of pieces basis can be obtained by counting the number of pieces of the particles of the soft magnetic mixed powder of each grain size, and the grain size distributions on volume basis and on mass basis at each grain size can be obtained by measuring the volume and the mass. Also, the grain size of all powder included in each grain size can be assumed to be constant. For example, all of the powder with the nominal grain size (x) can be assumed to have the grain size (x).

It is preferable that the sieves used for screening are those described in JIS Z 8801-1. In screening, it is preferable that the number of pieces of the grain size is 3 grain sizes or more.

Further, in the present invention, it is also possible to easily obtain the grain size distribution by the laser diffraction scattering method (micro-track method). In the laser diffraction scattering method (micro-track method), the particle size from the sub-micron range to approximately several millimeters is measured utilizing the fact that the diffracted light quantity diffracted when light is irradiated to a particle and the pattern differ according to the particle size. In the laser diffraction scattering method (micro-track method), measurement of dry type or wet type is possible, and measurement of dry type is preferable in applying the method to the pure iron powder, the soft magnetic iron-based alloy powder and the soft magnetic mixed powder of the present invention. Further, although the grain size distribution obtained by the laser diffraction scattering method is the grain size distribution on volume basis due to the measurement principle, it can be converted to the grain size distribution on mass basis by using the density of the pure iron powder and the soft magnetic iron-based alloy powder.

Also, with respect to the soft magnetic mixed powder of the present invention, when the mass rate of the soft magnetic iron-based alloy powder in the soft magnetic mixed powder with the grain size of cumulative 50% mass average grain size D50 or more of the soft magnetic iron-based alloy powder is made $R_{over}$ and the mass rate of the soft magnetic iron-based alloy powder in the soft magnetic mixed powder with the grain size of less than D50 is made $R_{under}$, the ratio of $R_{over}$ and $R_{under}$ ($R_{over}/R_{under}$) is 1.2 or more. When the ($R_{over}/R_{under}$) ratio is less than 1.2, the iron loss improvement effect cannot be secured, and the values of the strength and the maximum magnetic flux density become low. Therefore, the ($R_{over}/R_{under}$) ratio is preferably 2 or more, and more preferably 5 or more. The upper limit of the ($R_{over}/R_{under}$) ratio is not particularly limited, and when the value of $R_{under}$ is close to 0, ($R_{over}/R_{under}$) possibly becomes a very large value (for example $1\times10^3$). The ratio of $R_{over}$ and $R_{under}$ ($R_{over}/R_{under}$) is preferably $1\times10^3$ or less, more preferably $1\times10^2$ or less, and further more preferably $0.5\times10^2$ or less.

As the grain size of the soft magnetic iron-based alloy powder used is coarser, the value of the ratio of $R_{over}$ and $R_{under}$ ($R_{over}/R_{under}$) becomes larger, and as the grain size of the soft magnetic iron-based alloy powder used is finer, the value of the ratio of $R_{over}$ and $R_{under}$ ($R_{over}/R_{under}$) becomes smaller.

Also, with respect to the soft magnetic mixed powder of the present invention, it is preferable that the cumulative 50% mass average grain size D50 is 45 μm or more. It is preferable that D50 of the soft magnetic mixed powder is 45 μm or more because the mechanical strength improves. D50 is more preferably 50 μm or more, and more preferably 60 μm or more.

Figure 2:
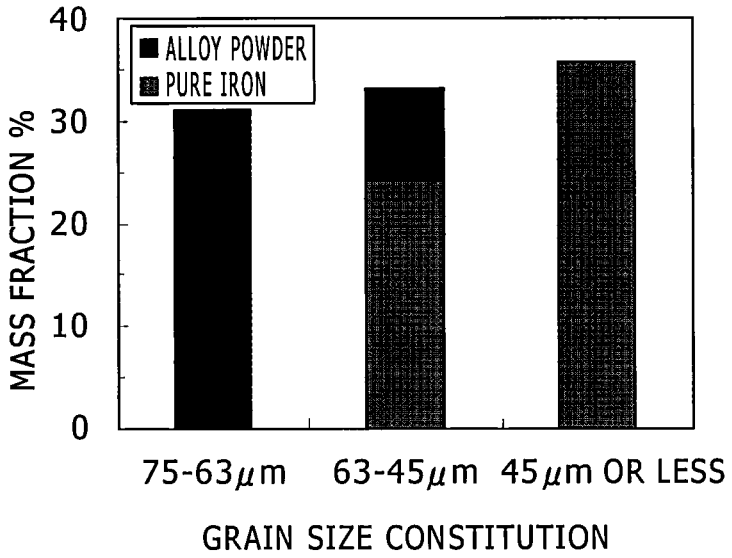
FIG. 2 shows an example of a grain size constitution of a case where the soft magnetic iron-based alloy powder of a coarse grain size and the pure iron powder are mixed with each other.

The cumulative 50% mass average grain size D50 is also called a median diameter. The cumulative 50% mass average grain size D50 expresses such particle diameter that, when the powder having a particle size distribution is divided into 2 of the powder coarser and the powder finer than the particle diameter, the masses of the coarse side and the fine side become equal to each other. FIG. 1 shows a grain size distribution of a mixing example according to a prior knowledge in which the alloy powder and the pure iron powder are mixed with each other with an equal rate in each grain size, and FIG. 2 shows a grain size distribution of a mixing example according to the present invention in which the alloy powder is mixed more in the relatively coarser grain size, and the pure iron powder is mixed more in the relatively finer grain size.

Figure 3:
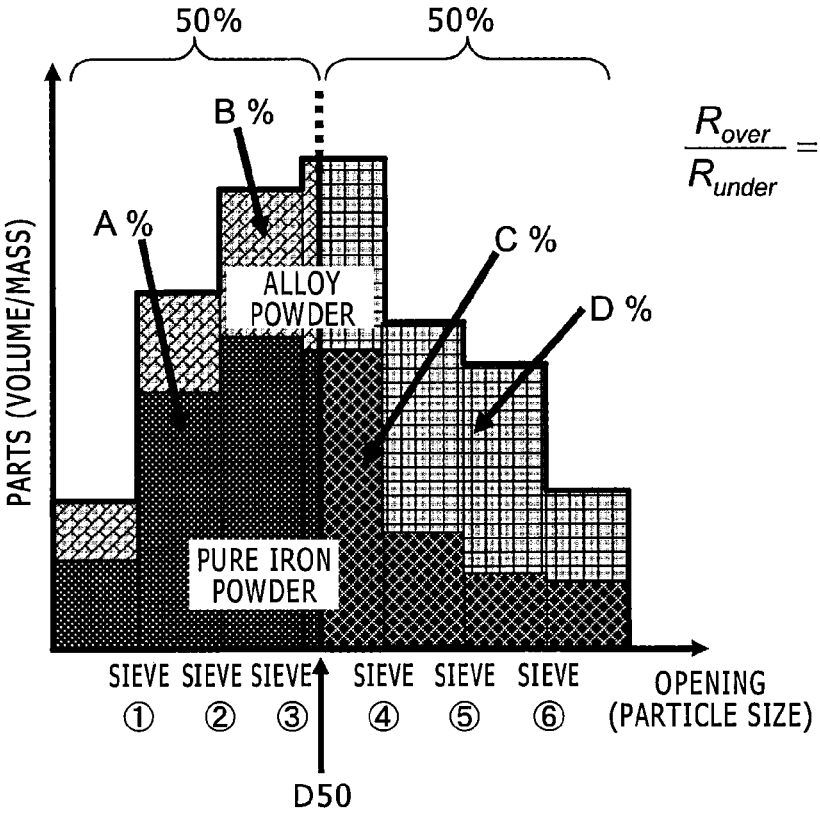
FIG. 3 shows an example of a grain size distribution obtained by screening.

In the present invention, the cumulative 50% mass average grain size D50 of the soft magnetic mixed powder can be obtained from the grain size distribution of the soft magnetic mixed powder. The grain size distribution of the soft magnetic mixed powder can be obtained for example by measuring the grain size distribution for each of the pure iron powder and the soft magnetic iron-based alloy powder by screening, and adding the content of the pure iron powder and the soft magnetic iron-based alloy powder with respect to each grain size. As an example shown in FIG. 3, when the grain diameter (grain size) that achieves the cumulative 50% mass average grain size D50 exists between the openings of a sieve (3) and a sieve (4), because the grain size distribution between the sieve (3) and the sieve (4) can be assumed to be constant, such value of the grain diameter (grain size) that achieves 50 mass % in accumulating the mass fractions from a grain size of the fine side or the coarse side becomes the cumulative 50% mass average grain size D50. D50 is not required to be measured to the decimal point or less, and it is enough to measure it with a value of an integer.

1-1. Soft Magnetic Iron-Based Alloy Powder

It is preferable that the soft magnetic iron-based alloy powder of the present invention contains either one or both of 1 mass % or more and 35 mass % or less of Al and 1 mass % or more and 19 mass % or less of Si in addition to Fe with the remainder being inevitable impurities. The content rate of Al in the soft magnetic iron-based alloy powder of the present invention is more preferably 2 mass % or more, and particularly preferably 3 mass % or more. Also, the content rate of Al is more preferably 20 mass % or less, still more preferably 10 mass % or less, and particularly preferably 8 mass % or less. Further, the content rate of Si in the soft magnetic iron-based alloy powder of the present invention is more preferably 1 mass % or more and 15 mass % or less, still more preferably 1 mass % or more and 12 mass % or less, and particularly preferably 1 mass % or more and 10 mass % or less.

The soft magnetic iron-based alloy powder of the present invention is preferable to be an alloy powder containing Fe, 1 mass % or more and 35 mass % or less of Al, and 1 mass % or more and 19 mass % or less of Si, an alloy powder containing Fe and 1 mass % or more and 35 mass % or less of Al, or an alloy powder containing Fe and 1 mass % or more and 19 mass % or less of Si.

Also, in the composition range described above, from the viewpoint of being excellent in the magnetic characteristics in high frequency, the soft magnetic iron-based alloy powder is preferable to be the Sendust powder composed of Fe, 5 mass % or more and 6 mass % or less of Al, and 9 mass % or more and 10 mass % or less of Si, Fe-3% Si powder containing Fe and 1 mass % or more and 4 mass % or less of Si, and Fe-6.5% Si alloy powder containing Fe and 6 mass % or more and 7 mass % or less of Si, and is particularly preferable to be the Sendust powder.

Although the effect of the present invention can be obtained even when permalloy, permendur and the like excellent in soft magnetic characteristics are used, it is not preferable in terms that the material cost increases because expensive elements are used. Further, although the effect itself of the present invention can be obtained even when the amorphous alloy and the microcrystal alloy are used as the soft magnetic iron-based alloy powder of the present invention, when the amorphous alloy or the microcrystal alloy is used, in manufacturing the powder magnetic core, crystallization or growth of the crystal grain possibly occurs by strain relieving annealing after compressive forming, and the coercive force possibly increases extremely. Therefore, as the soft magnetic iron-based alloy powder of the present invention, crystalline alloy powder is preferable.

Although the mode of the grain size of the soft magnetic iron-based alloy powder used for the soft magnetic mixed powder of the present invention can be appropriately selected in the range the ratio of the mode of the grain size of the soft magnetic iron-based alloy powder and the pure iron powder (the mode of the grain size of the soft magnetic iron-based alloy powder/the mode of the grain size of the pure iron powder) becomes 0.9 or more and less than 5, it is preferable that the mode of the grain size distribution of the soft magnetic iron-based alloy powder is 40 μm or more for example. As the mode of the grain size distribution of the soft magnetic iron-based alloy powder becomes larger, the iron loss of the powder magnetic core obtained reduces and the mechanical strength improves. Therefore, the mode of the grain size distribution of the soft magnetic iron-based alloy powder is preferably 50 μm or more, and more preferably 60 μm or more. Also, when the mode of the grain size distribution of the soft magnetic iron-based alloy powder becomes large, the iron loss increases due to the eddy current loss inside the particles, and the soft magnetic mixed powder is liable to be segregated. Therefore, the mode of the grain size distribution of the soft magnetic iron-based alloy powder is preferably 150 μm or less, more preferably 140 μm or less, and further more preferably 120 μm or less. The mode of the grain size of the soft magnetic iron-based alloy powder can be adjusted by that the pure iron powder is sieved, the pure iron powders of respective grain sizes are mixed with each other at a desired rate, and so on.

The soft magnetic iron-based alloy powder used for the soft magnetic mixed powder of the present invention is obtained by making the soft magnetic iron-based alloy material into powder. As the method for making the soft magnetic iron-based alloy material into powder, the atomize process (the water atomize process or the gas atomize process) and the grinding process can be cited.

The atomize process is a method for obtaining metal powder by that the molten metal is made into a small stream, high speed gas or liquid is blown to the small stream, and the molten metal is thereby scattered, rapidly cooled and solidified. The metal powder manufactured by the gas atomize method has a shape close to a spherical shape and has a high density. With respect to the metal powder manufactured by the water atomize process, because the particle shape is complicated, the particles are engaged with each other in compressive forming, and the mechanical strength of the powder magnetic core obtained is high.

Also, the grinding process is a method for obtaining the metal powder by manufacturing a metal ingot by casting, subjecting to homogenizing heat treatment, and thereafter mechanically grinding the metal ingot by working of a jaw crusher and a ball mill and so on. The grinding process is suitable to grinding of brittle material such as Sendust and the like.

According to the water atomize process, because hardly reducible oxide is formed on the surface, the soft magnetic iron-based alloy material manufactured by the gas atomize process or the grinding method is preferable. Also, with respect to the soft magnetic iron-based alloy material obtained by the grinding process, cracks exist within the powder particles and deteriorate the magnetic characteristics, and therefore the soft magnetic iron-based alloy material obtained by the gas atomize process is more preferable.

It is preferable to subject these alloy powders to heat treatment within an inert gas or a reducing gas after manufacturing. By executing the heat treatment within an inert gas or a reducing gas, the strain accumulated in grinding can be removed with respect to the ground powder, the segregation accompanying solidification can be eliminated with respect to the gas atomize powder, and the amount of the surface oxide/oxidized inclusions can be reduced with respect to the water atomize powder. As the inert gas, nitrogen gas, argon gas and the like can be cited for example, and as the reducing gas, hydrogen gas, gas mixture of hydrogen gas and inert gas, and the like can be cited for example.

Also, the soft magnetic iron-based alloy powder of the present invention produces excellent magnetic characteristics because the crystal structure is of peculiar $D0_3$ phase. The $D0_3$ phase is formed by heating the alloy having the suitable composition described above to a temperature of 850° C. or above within an inert gas or a reducing gas. Therefore, in order to obtain the soft magnetic iron-based alloy powder of the present invention, it is preferable to be heated to a temperature of 850° C. or above and to be thereafter cooled slowly. The heat treatment temperature is preferably 900° C. or above, and more preferably 920° C. or above. When the heat treatment temperature becomes excessively high, the soft magnetic iron-based alloy powder becomes liable to be fused and joined which therefore is not preferable. Accordingly, in order to manufacture the soft magnetic iron-based alloy powder of the present invention, the heat treatment temperature is preferably 1,250° C. or below, and more preferably 1,200° C. or below. The heat treatment time should just be 1 hour or more.

1-2. Pure Iron Powder

With respect to the pure iron powder of the present invention, the less the impurity elements are contained, the better. As the inclusions derived from the impurities are less, excellent magnetic characteristics can be imparted.

Although the mode of the grain size of the pure iron powder used for the soft magnetic mixed powder of the present invention can be appropriately selected in the range in which the ratio of the mode of the grain size of the soft magnetic iron-based alloy powder and the pure iron powder (the mode of the grain size of the soft magnetic iron-based alloy powder/the mode of the grain size of the pure iron powder) becomes 0.9 or more and less than 5, it is preferable that the mode of the grain size of the pure iron powder is 25 μm or more for example. As the mode of the grain size distribution becomes larger, the segregation is suppressed. Therefore, the mode of the grain size of the pure iron powder is preferably 30 μm or more, and more preferably 35 μm or more. Also, when the mode of the grain size of the pure iron powder becomes larger, the iron loss increases due to the eddy current loss within the particles. Also, because the mechanical strength of the powder magnetic core obtained improves as the mode of the grain size distribution of the pure iron powder is lower, the mode of the grain size of the pure iron powder is preferably 80 μm or less, more preferably 75 μm or less, and further more preferably 70 μm or less. The mode of the grain size of the pure iron powder can be adjusted by screening the pure iron powder, mixing the pure iron powder of respective grain sizes with a desired rate, and so on.

With respect to the pure iron powder used for the soft magnetic mixed powder of the present invention, it is preferable that the mixing rate relative to the soft magnetic mixed powder is 40 mass % or more and 95 mass % or less. When the rate of the pure iron powder is large, the density of the formed body improves, and, as a result, the maximum magnetic flux density improves. Therefore, the mixing rate of the pure iron powder relative to the soft magnetic mixed powder is preferably 50 mass % or more, and more preferably 55 mass % or more. When the mixing rate of the pure iron powder is excessively high, the iron loss becomes hard to be reduced. Therefore, the mixing rate of the pure iron powder relative to the soft magnetic mixed powder is preferably 90 mass % or less, and more preferably 75 mass % or less.

The pure iron powder used for the soft magnetic mixed powder of the present invention can be obtained by making the pure iron material into powder. As the method for making the pure iron material into powder, the atomize method (the gas atomize method or the water atomize method) or the electrolytic process can be cited. The electrolytic process is a method for obtaining iron powder by electrolytically depositing iron from an aqueous solution of iron sulfate, iron chloride, and the like. When the mechanical strength is to be emphasized, the water atomize powder whose particle shape is complicated is preferable, whereas when high density is required, the gas atomize powder whose particle shape is close to spherical shape is preferable, however the present invention is not limited to them.

It is preferable that the pure iron powder is one subjected to heat treatment within an inert gas or a reducing gas. Particularly in the water atomize method, in forming the powder, hardly reducible oxide is liable to be formed on the surface, therefore, when the pure iron powder is used for the soft magnetic iron-based alloy powder, it is preferable that such oxide on the particle surface and inclusions within the particles have been eliminated. As the inert gas or reducing gas, those similar to the above can be cited.

The lower limit of the heat treatment temperature is not particularly limited, and, for example, heat treatment at 850° C. or above is preferable. By heat treatment at 850° C. or above, the particle size of the crystal within the coarse pure iron powder can be coarsened, and therefore the hysteresis loss of the powder magnetic core can be reduced. The heat treatment temperature described above is preferably 950° C. or above, and more preferably 1,000° C. or above. However, when the heat treatment temperature becomes excessively high, sintering proceeds excessively, and, as a result, the pure iron powder is liable to be fused and joined. Therefore, in order to manufacture the pure iron powder of the present invention, the heat treatment temperature is preferably 1,250° C. or below, and more preferably 1,200° C. or below.

1-3. Mixing Method

The soft magnetic mixed powder of the present invention is obtained by mixing the pure iron powder and the soft magnetic iron-based alloy powder with each other. In order to achieve a predetermined mixing rate and grain size constitution of the pure iron powder and the soft magnetic iron-based alloy powder in the soft magnetic mixed powder, those obtained by screening and classifying the pure iron powder and the soft magnetic iron-based alloy powder respectively to each grain size beforehand should just be used and be mixed with each other so as to become the predetermined mixing rate and grain size constitution. The method for mixing the pure iron powder and the soft magnetic iron-based alloy powder with each other is not particularly limited, and prior known methods can be used. For example, mixing can be executed by known mixing machines such as a mixer and the like.

In the soft magnetic mixed powder, the grain size constitution of the pure iron powder and the soft magnetic iron-based alloy powder is measured as described below. First, the soft magnetic mixed powder is screened with different openings, and the soft magnetic mixed powder is classified into each grain size. Next, by counting the number of pieces of the particles of each of the pure iron powder and the soft magnetic iron-based alloy powder in each grain size, the rate of number of pieces of the pure iron powder and the soft magnetic iron-based alloy powder in the soft magnetic mixed powder of each grain size can be obtained. The rate of number of pieces can be converted to the volume rate of each grain size using the number of pieces average particle size (the grain size itself) of each grain size, and the volume rate can approximate the mass rate of each grain size using the density of the pure iron powder and the soft magnetic iron-based alloy powder. When the mass of each grain size can be measured directly, it is preferable to obtain the mass rate by measuring the mass. Thus, the grain size constitution (number of pieces rate, volume rate, mass rate) of the pure iron powder and the soft magnetic iron-based alloy powder can be measured. In measuring the grain size constitution of the pure iron powder and the soft magnetic iron-based alloy powder, it is preferable to identify the powder of 50 pieces or more for each grain size.

Figure 5:
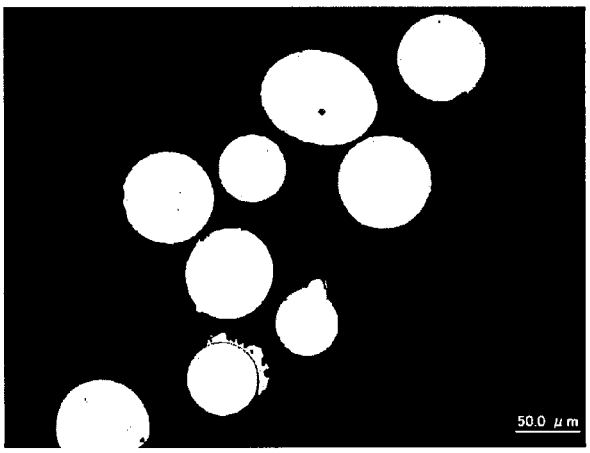
FIG. 5 shows SEM images showing the shape of the Sendust powder obtained by the gas atomize method and the pulverizing method and the pure iron powder obtained by the water atomizing method.
Figure 5:
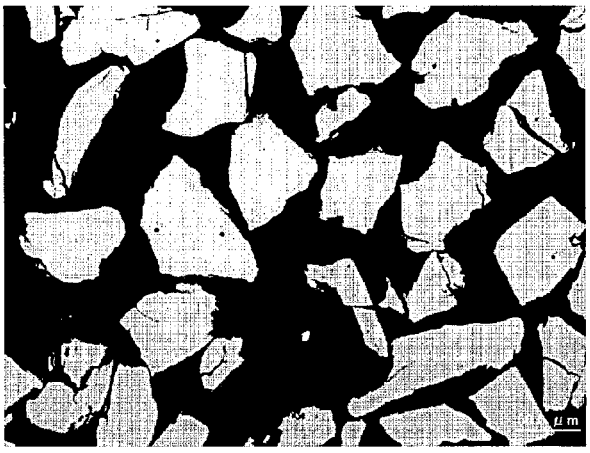
Figure 5:
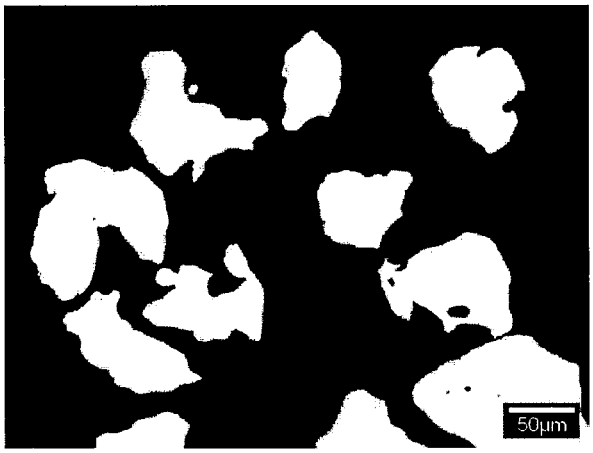

The soft magnetic iron-based alloy powder and the pure iron powder can be identified by the difference in the color confirmed by an optical microscope, the difference in the hardness, the energy dispersive X-ray analysis (EDS) and the like using a scanning electron microscope (SEM) and the like. Also, when each of the pure iron powder and the soft magnetic iron-based alloy powder is manufactured by different methods such as the atomize method, grinding method and the like, it is also possible to observe the shape by an optical microscope or SEM, and to identify them by the shape. As shown in FIG. 5, the powder manufactured by the gas atomize method has a smooth spherical shape on the surface, the powder manufactured by the water atomize method has smooth unevenness on the surface, and the powder manufactured by the grinding method has sharp unevenness on the surface. Also, when the difference in density is large between the pure iron powder and the soft magnetic iron-based alloy powder in the soft magnetic mixed powder, the pure iron powder and the soft magnetic iron-based alloy powder can be separated from each other using an air classifier.

Figure 4:
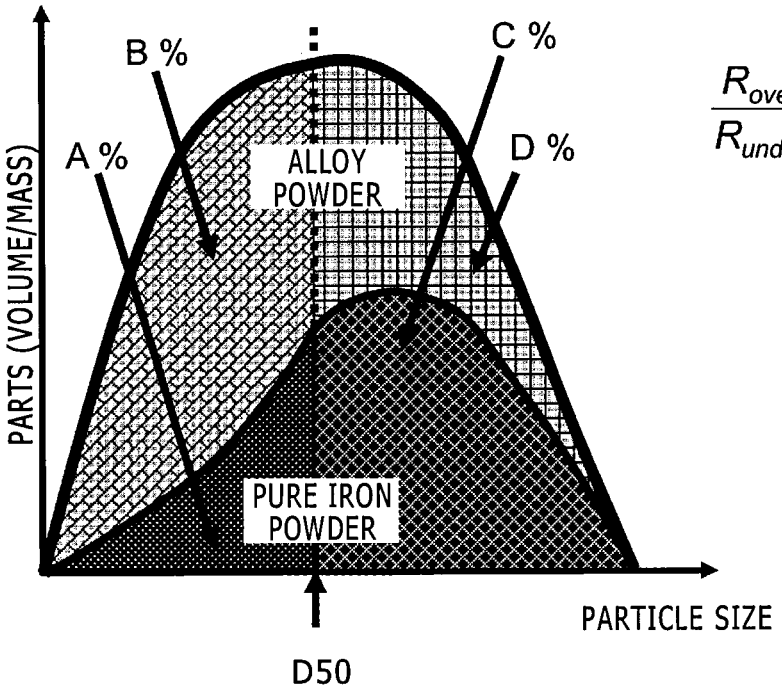
FIG. 4 shows an example of a grain size distribution obtained by laser diffraction scattering measurement.

Further, the grain size constitution described above can be easily calculated also by the laser diffraction scattering method (micro-track method) (refer to FIG. 4).

When the pure iron powder and the soft magnetic iron-based alloy powder having unknown grain size constitution are to be mixed with each other, the grain size constitution can be measured by the methods described above. Also, when the classified pure iron powder and soft magnetic iron-based alloy powder of each grain size have been prepared, by changing the mixing rate for each grain size, any grain size constitution can be obtained.

1-4. Insulation Layer

The soft magnetic mixed powder obtained by mixing the pure iron powder and the soft magnetic iron-based alloy powder with each other can be used as the soft magnetic mixed powder as it is, and can be used also as the soft magnetic mixed powder with the insulation layer described below being further formed on the surface thereof. From the viewpoint of reducing the iron loss, particularly the eddy current loss, it is preferable to form the insulation layer on the surface of the soft magnetic mixed powder.

As one constituting the insulation layer, an insulating inorganic layer and an insulating resin layer can be cited for example. On the surface of the insulating inorganic layer, it is preferable to further form an insulating resin layer. When the insulation layer is to be formed, it is preferable that the thickness of the insulation layer (for example the total thickness of the insulating inorganic layer and the insulating resin layer) is 250 nm or less. When the film thickness exceeds 250 nm, the magnetic flux density may possibly lower further.

1-4-1. Insulating Inorganic Layer (Including the Forming Method)

As the insulating inorganic layer, a phosphoric acid-based chemical conversion coating layer, a chromium-based chemical conversion coating layer, a water glass layer, an oxide layer and the like can be cited for example, and the phosphoric acid-based chemical conversion coating layer is preferable. Although the insulating inorganic layer may be formed by laminating the layers of two kinds or more, a single layer is enough normally.

The composition of the phosphoric acid-based chemical conversion coating layer is not particularly limited as far as the coating layer is an amorphous-like or glass-like layer formed using a compound containing P. The phosphoric acid-based chemical conversion coating layer may contain the elements of one kind or two kinds or more selected from a group consisting of Ni, Co, Na, K, S, Si, B, Mg and the like in addition to P. These elements have an action of suppressing that oxygen forms a semiconductor with Fe and lowers the specific resistance in the heat treatment step described above.

The thickness of the phosphoric acid-based chemical conversion coating layer is preferable to be approximately 1-250 nm. When the film thickness is thinner than 1 nm, the insulation effect may not be produced. Also, when the film thickness exceeds 250 nm, the insulation effect saturates, and it is not preferable from the point that the density of the powder magnetic core becomes high. The film thickness is preferably 10-50 nm.

The powder formed with the phosphoric acid-based chemical conversion coating layer used in the present invention may be manufactured in any form. For example, the powder formed with the phosphoric acid-based chemical conversion coating layer can be obtained by that the solution obtained by dissolving a compound containing P in a solvent formed of water and/or organic solvent and the soft magnetic iron-based powder formed into coarse powder are mixed with each other, and the solvent is thereafter evaporated according to the necessity. As the solvent used in the present step, water, hydrophilic organic solvent such as alcohol, ketone and the like, and the mixture thereof can be cited. Known surfactant may be added to the solvent.

1-4-2. Insulating Resin Layer (Including the Forming Method)

As the insulating resin layer, a silicone resin layer, phenolic resin layer, epoxy resin layer, polyamide resin layer, polyimide resin layer and the like can be cited for example. The silicone resin layer is preferable. Although the insulating resin layer may be formed by laminating the layers of two kinds or more, a single layer is enough normally. Also, "insulating" described above means that the final specific resistance of the powder magnetic core preferably becomes approximately 50 μΩ·m or more when measured by 4 terminal method.

From the viewpoint of the thermal stability, it is preferable to use methylphenyl silicone resin with 50 mol % or more of the methyl group, the rate of the methyl group relative to the total of the methyl group and the phenyl group is more preferable to be 70 mol % or more, and the methyl silicone resin not having the phenyl groups at all is further more preferable.

The thickness of the silicone resin layer is preferably 1-200 nm, and more preferably 20-150 nm.

Also, on top of the phosphoric acid-based chemical conversion coating layer, the silicone resin layer may be provided further. Thus, the powders are joined securely when the cross-linking/curing reaction of the silicone resin is completed (at the time of compressing). Also, the Si—O bond excellent in heat resistance is formed, and the thermal stability of the insulation layer can be improved.

The silicone resin layer can be formed for example by mixing a silicone resin solution and the soft magnetic mixed powder with each other, the silicone resin solution being obtained by dissolving the silicone resin into an alcohol group, petroleum-based organic solvent such as toluene, xylene and the like, and evaporating the organic solvent next according to the necessity. As the soft magnetic mixed powder, soft magnetic mixed powder having the phosphoric acid-based chemical conversion coating layer (the phosphoric acid-based chemical conversion coating layer-formed powder) is preferable.

2. Powder Magnetic Core

By compressively forming the soft magnetic mixed powder of the present invention, the powder magnetic core can be obtained. The powder magnetic core of the present invention is preferably applied to electromagnetic components used in drive frequency of high frequency for example a core of an inductor (choke coil, noise filter, reactor and the like), and is also preferably applied to electro-magnetic components used in drive frequency of low frequency, for example, a core of a rotor or a stator of a motor.

The powder magnetic core of the present invention is obtained by using a press machine and a mold, and compressively forming the soft magnetic mixed powder. The appropriate condition of compressive forming is 490-1,960 MPa for example in terms of the compacting pressure. With respect to the forming temperature, both of room temperature forming and warm temperature forming (for example 100-250° C.) are possible.

In forming the soft magnetic mixed powder, lubricant may be further blended to the soft magnetic mixed powder. With respect to the lubrication method, both of the inside lubricating method of dispersing the lubricant into the powder or coating the powder with the lubricant and the mold lubricating method of spraying and blowing the lubricant onto the mold are possible. As the concrete form of coating the powder with the lubricant, such form can be cited that the lubricant formed of organic substance is provided on the surface or the inside of the insulation layer, and so on. By an action of the lubricant, the friction resistance between the powders or between the soft magnetic mixed powder and the inner wall of the forming mold in forming the soft magnetic mixed powder can be reduced, and mold galling by the formed body and heat generation in forming can be prevented. From the viewpoint of obtaining the powder magnetic core having a higher strength, the mold lubricating method is preferable. When the mold lubricating forming and the warm temperature forming are executed simultaneously, the powder magnetic core having still higher strength is obtained which is therefore preferable.

Also, because the soft magnetic mixed powder in which the soft magnetic alloy powder and the pure iron powder are mixed with each other has powders with different hardness in the powder, the soft powder deforms preferentially rather than the hard powder, and the soft powder positioned around the hard powder in particular is subjected to high strain. By providing the lubricant formed of the organic substance on the surface or in the insulation layer, the soft magnetic mixed powder in relation with the present invention can improve the compressibility in forming work, and the density of the formed body can be improved. Such effect of improving the compressibility is obtained by that excessive friction generated around the soft magnetic iron-based alloy powder that is hardly deformed is reduced by the lubricant. In the soft magnetic mixed powder, it is important that the lubricant formed of the organic substance is provided on the surface or in the insulation layer at least of the soft magnetic iron-based alloy powder.

The effect of being capable of improving the compressibility in forming work and improving the density of the formed body by provision of the lubricant on the surface or within the resin layer is more significant as the mixing rate of the soft magnetic iron-based alloy powder is higher in the soft magnetic mixed powder. Particularly, when the mixing rate of the soft magnetic iron-based alloy powder is 20 mass % or more, preferably 30 mass % or more, and further more preferably 40 mass % or more for example, the effect of improving the compressibility and improving the density of the formed body by adding the lubricant becomes more significant.

As the lubricant, those conventionally known can be used, and in concrete terms, the metal salt powder of the stearic acid such as zinc stearate, lithium stearate, calcium stearate and the like, fatty acid amide such as polyhydroxycarboxylic acid amide, ethylene-bis-stearic acid amide (ethylene-bis-stearylamide), (N-octadecenyl) hexadecane acid amide and the like, paraffin, wax, natural or synthetic resin derivative and the like can be cited. These lubricants can be used alone, and can be used combining two kinds or more. Among them, fatty acid amide is preferable, and polyhydroxycarboxylic acid amide is more preferable.

Although the method for adding the lubricant on the surface or within the insulation layer of the soft magnetic mixed powder is not particularly limited as far as the lubricant can be imparted to the surface of the powder, a method of adding the powder-like lubricant to the powder mixture and stirring and mixing by a mixer such as a V-type mixer (a mixer in which a container rotates, and the powder and granular material inside the container moves as a total and executes the convection movement) (powder mixing method) and a method of imparting the lubricant to the organic system insulation resin layer covering the outermost surface of the powder mixture (layer mixing method) can be used. Although the organic system insulation layer is treated by mixing the treatment solution obtained by adding a resin to an organic solvent such as toluene and the like with the soft magnetic mixed powder, by dissolving or dispersing the lubricant to this organic solvent, treatment of the layer and adding of the lubricant can be executed simultaneously also. Further, in the process of manufacturing the soft magnetic mixed powder, when the lubricant is added before the soft magnetic iron-based alloy powder and the pure iron powder are mixed with each other, it is also possible to impart the lubricant to either one kind only.

Out of the powder mixing method and the layer mixing method, according to the powder mixing method, because the lubricant is present at the outermost surface and the excessive friction generated around the soft magnetic iron-based alloy powder can be directly reduced, the compressibility can be improved further more. Also, according to the layer mixing method, because the lubricant can be added simultaneously with formation of the insulation layer, it is industrially advantageous.

When the lubricant is to be dispersed into the powder, it is preferable that the mass rate of the lubricant is 0.2 mass % or more and 1 mass % or less in terms of the mass rate relative to the mass of the total soft magnetic mixed powder. The mass rate of the lubricant is more preferably 0.3 mass % or more, and further more preferably 0.4 mass % or more. However, even when the lubricant is blended so as to exceed 1 mass %, the effect thereof saturates, and, when the amount of the lubricant increases, the density of the formed body reduces, and the magnetic characteristics may possibly deteriorate. Therefore, the mass rate of the lubricant is preferably 1 mass % or less, more preferably 0.9 mass % or less, and further more preferably 0.8 mass % or less. Also, in a case of forming after the lubricant is sprayed on the inner wall surface of the mold in forming (mold lubrication forming), the lubricant amount can be less than 0.2 mass %. Further, in a case where the powder is coated with the lubricant, for example a case where lubricant formed of organic substance is provided on the surface or within the insulation layer, and so on, the mass rate of the lubricant is preferably 0.1 mass % or more and 0.6 mass % or less relative to 100 mass % of the total soft magnetic mixed powder, more preferably 0.15 mass % or more, and further more preferably 0.2 mass % or more. As the mass rate of the lubricant is higher, excessive friction generated around the soft magnetic iron-based alloy powder that is hardly deformed can be reduced, the compressibility in forming work can be improved, and the density of the formed body can be improved. When the mass rate of the lubricant is excessively high, the effect saturates, and the compressibility in forming work may possibly deteriorate to the contrary. Therefore, the mass rate of the lubricant is more preferably 0.5 mass % or less, further more preferably 0.4 mass % or less, and particularly preferably 0.39 mass % or less.

Next, according to the present invention, the powder magnetic core can be manufactured subjecting the formed body described above to heat treatment. Thus, the strain having been introduced in compressive forming is released, and the hysteresis loss of the powder magnetic core caused by the strain can be reduced. The heat treatment temperature then is preferably 400° C. or above, more preferably 450° C. or above, and further more preferably 500° C. or above. When the specific resistance does not deteriorate, the step is preferable to be executed at a higher temperature. However, when the heat treatment temperature exceeds 700° C., the insulation layer may possibly be broken. When the insulation layer is broken, the iron loss, particularly the eddy current loss, increases and the specific resistance deteriorates which therefore is not preferable. Accordingly, the heat treatment temperature is preferably 700° C. or below, and more preferably 650° C. or below.

The atmosphere at the time of the heat treatment described above is not particularly limited, and can be under air atmosphere, under inert gas atmosphere, or under vacuum. As the inert gas, nitrogen, rare gas such as helium and argon, and so on can be cited. Although the heat treatment time is not particularly limited as far as the specific resistance does not deteriorate, 20 min or more is preferable, 30 min or more is more preferable, and 1 hr or more is further more preferable.

When the heat treatment is executed with the above condition, the insulation layer hardly breaks, and therefore the powder magnetic core having high electric insulation that is high specific resistance can be manufactured without increasing the iron loss, particularly the eddy current loss (equivalent to the coercive force also).

The formed body is subjected to the heat treatment described above and is cooled thereafter to return to the room temperature, and the powder magnetic core in relation with the present invention is thereby obtained.

The present application is to claim the benefit of the right of priority based on Japanese Patent Application No. 2012-221698 applied on Oct. 3, 2012 and Japanese Patent Application No. 2013-032625 applied on Feb. 21, 2013. All contents of the description of Japanese Patent Application No. 2012-221698 applied on Oct. 3, 2012 and Japanese Patent Application No. 2013-032625 applied on Feb. 21, 2013 are incorporated into the present application by reference.

EXAMPLE

Although the present invention will be described more specifically below referring to examples, the present invention is not limited by the examples described below, it is a matter of course that the present invention can be also implemented with modifications being added appropriately within the scope adaptable to the purposes described above and below, and any of them is to be included within the technical range of the present invention. Further, unless otherwise stated, "part" hereinafter means "mass part", and "%" means "mass %".

The measuring method used in the examples described below is as follows.

AC Magnetism Measurement

With respect to the measurement specimens described above, the iron loss was measured using an AC B-H analyzer with 0.1 T maximum magnetic flux density and 30 kHz frequency.

Laser Diffraction Measurement

Also, the average grain size (the median diameter on volume basis) D50 of each soft magnetic mixed powder was measured using a laser diffraction measurement apparatus (HORIBA, LA-920).

3 Point Bending Test

The strength of the compression formed body was evaluated by measuring the transverse rupture strength. The transverse rupture strength was measured by executing the transverse rupture strength test using a plate-like compression formed body. The test was executed by a three point bending test according to JPMA M 09-1992 (Japan Powder Metallurgy Association; Method for testing transverse rupture strength of sintered metal material). The transverse rupture strength was measured using a tensile tester with the distance between support points of 25 mm.

The soft magnetic iron-based powder shown below was prepared, and the powder magnet core was manufactured by a procedure shown below.

Manufacturing of Pure Iron Powder

As the pure iron powder, "Atmel® 300NH" (made by Kobe Steel) which was the water atomize pure iron powder was used. By screening using the sieves with the opening of 150, 106, 75, 63, 45 μm, the pure iron powder of each grain size was obtained.

Manufacturing of Soft Magnetic Iron-Based Alloy Powder

As the soft magnetic iron-based alloy, Fe-9.6% Si-5.5% Al alloy (Sendust), Fe-6.5% Si alloy, and Fe—Si—B—C system amorphous alloy were used. Sendust was made into a steel ingot having the Sendust composition (Fe-9.6% Si-5.5% Al) by vacuum high frequency melting, the steel ingot obtained was ground by a vibrating ball mill, and the Sendust alloy powder was manufactured. Fe-6.5% Si alloy and Fe—Si—B—C system amorphous alloy were made into powder by the gas atomize method.

With respect to the soft magnetic iron-based alloy powder obtained also, by screening using the sieves with the opening of 150, 106, 75, 63, 45 μm, the soft magnetic iron-based alloy powder of each grain size was obtained.

(Mixing of Pure Iron Powder and Soft Magnetic Iron-Based Alloy Powder)

Figure 6:
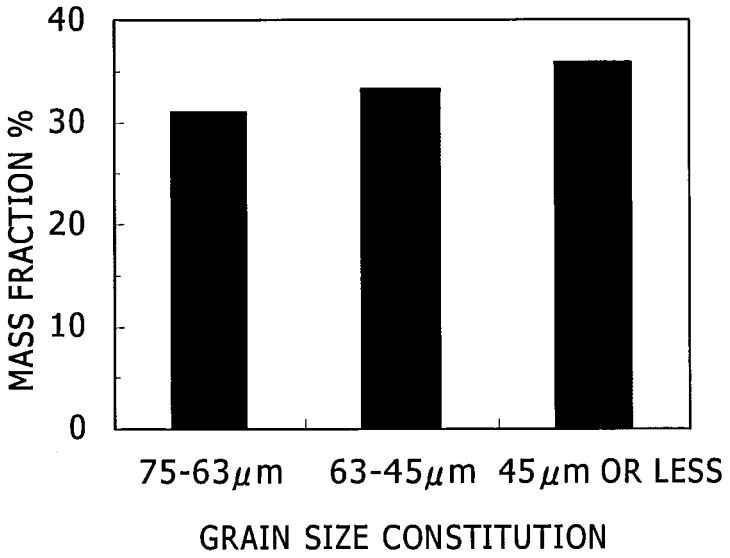
FIG. 6 shows a grain size constitution of the grain size 1 used in an example.
Figure 7:
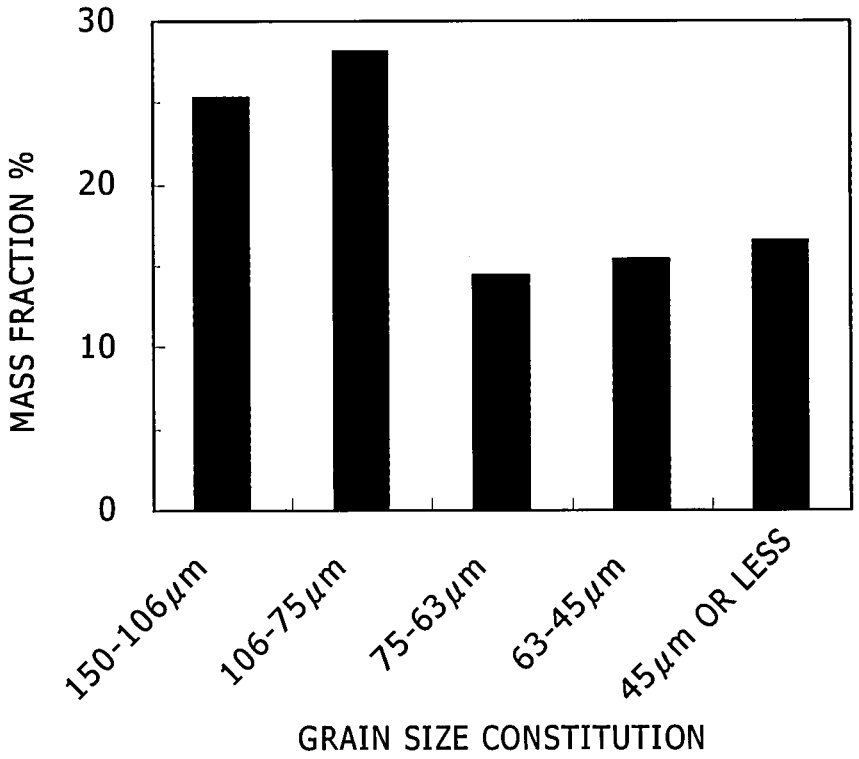
FIG. 7 shows a grain size constitution of the grain size 2 used in an example.
Figure 8:
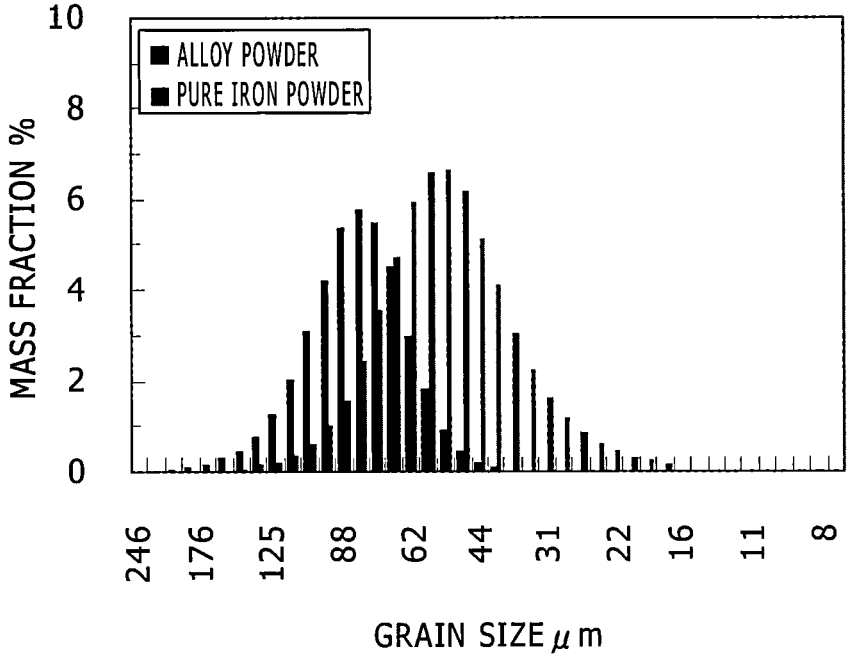
FIG. 8 shows a grain size constitution of the soft magnetic mixed powder of No. 6.
Figure 9:
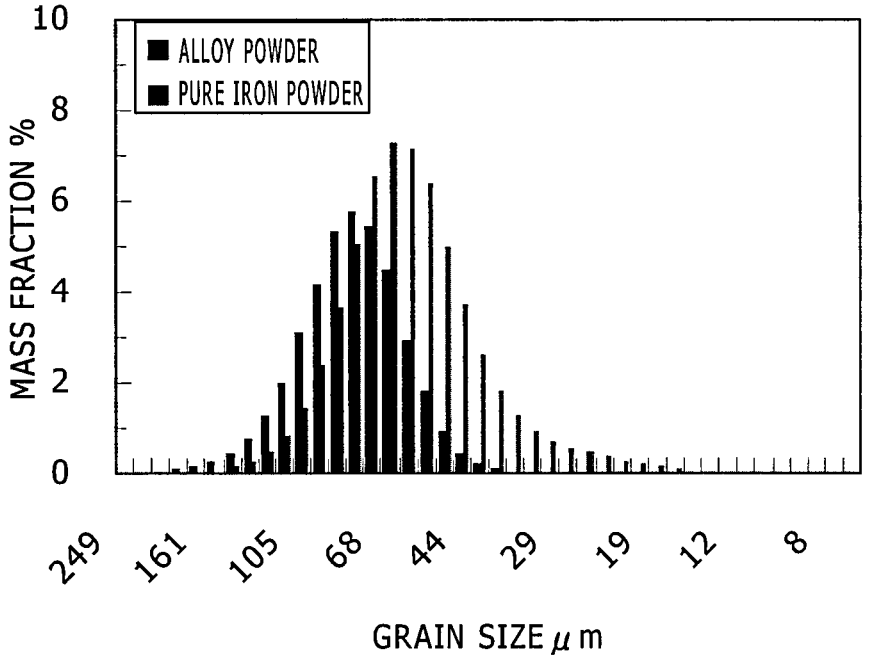
FIG. 9 shows a grain size constitution of the soft magnetic mixed powder of No. 7.
Figure 10:
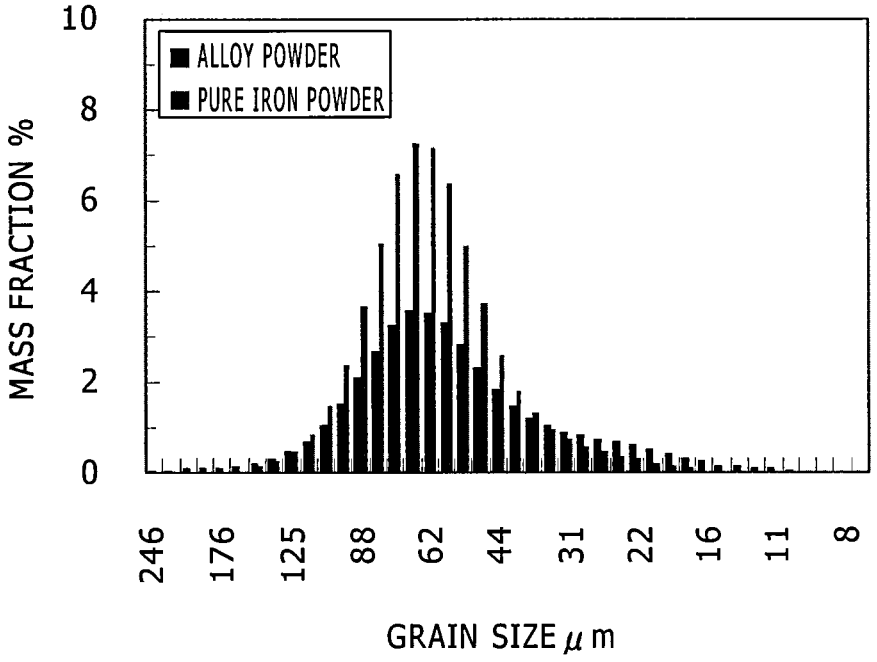
FIG. 10 shows a grain size constitution of the soft magnetic mixed powder of No. 8.
Figure 11:
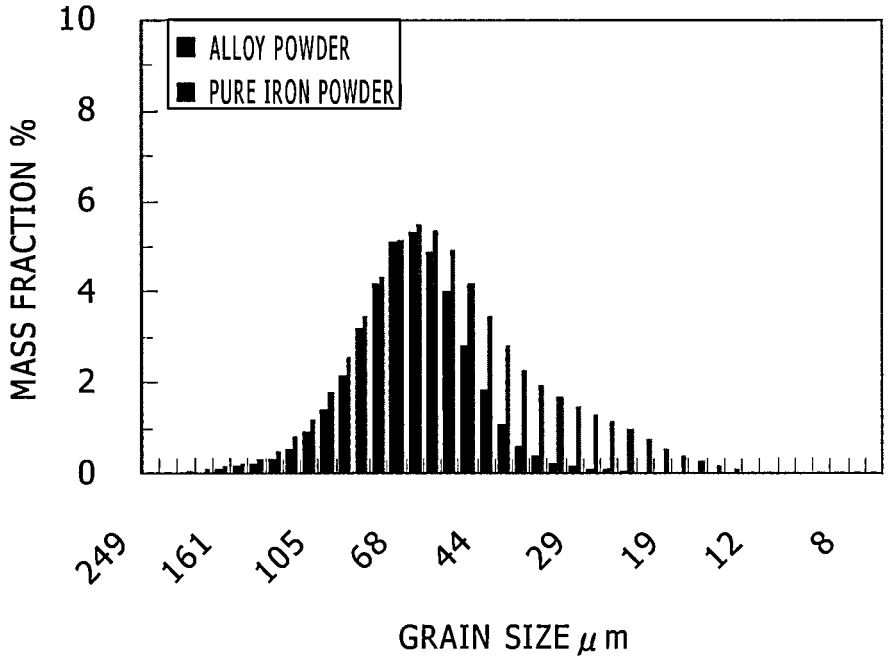
FIG. 11 shows a grain size constitution of the soft magnetic mixed powder of No. 9.
Figure 12:
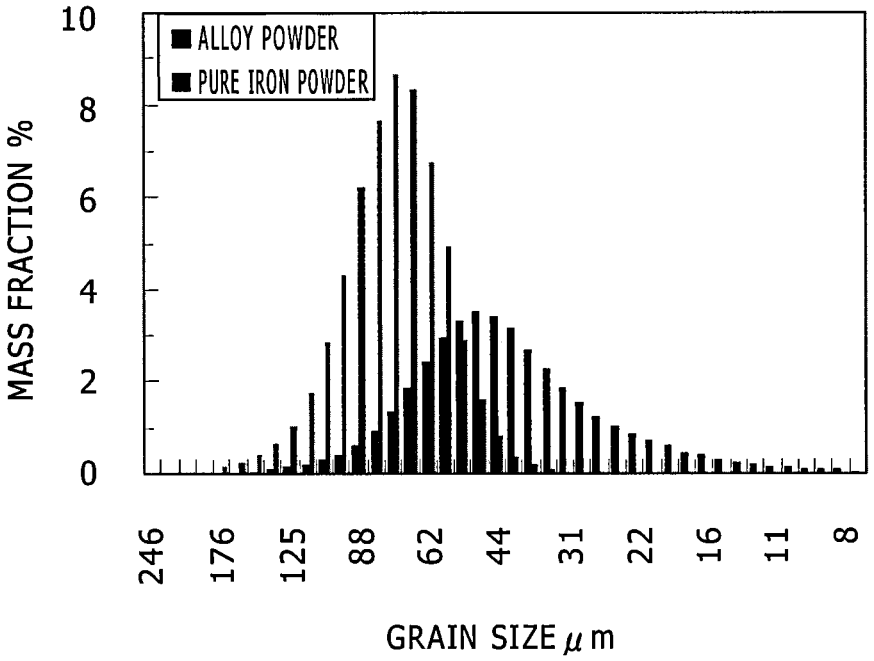
FIG. 12 shows a grain size constitution of the soft magnetic mixed powder of No. 10.

The pure iron powder and the soft magnetic iron-based alloy powder were mixed with each other with each mixing rate and grain size shown in Table 1, and the soft magnetic mixed powder for evaluation was manufactured. With respect to the grain size of the alloy powder and the pure iron powder to be mixed, the powder obtained by mixing the alloy powder so as to be the coarse side grain size was manufactured as the present invention example, the powder obtained by being mixed equally into each grain size and the powder obtained by mixing the alloy powder so as to be the fine side grain size were manufactured as the comparative example, and the ($R_{over}/R_{under}$) ratio was changed in the range of 0.01-41.80. The mixing amount of the alloy powder was made 20% or 40%, and the overall grain size was made to be two alternatives of grain size 1 and grain size 2 shown in FIGS. 6 and 7. The detail thereof is shown in Table 1 along with the measurement result.

TABLE 1

| No. | Alloy powder | Grain size | Mixing rate of alloy powder | Grain size ratio* | $R_{over}/R_{under}$ ratio | D50 (μm) | Iron loss (kW/m$^3$) | Density (g/cm$^3$) | Transverse rupture strength (MPa) | |
|---|---|---|---|---|---|---|---|---|---|---|
| 1 | Fe—9.6%Si—5.5%Al | Grain | 20% | 1.54 | 9.05 | 65 | 489.5 | 7.18 | 63.2 | Invention example |
| 2 | alloy (Sendust) | size 1 | | 1.19 | 3.59 | | 501.8 | 7.13 | 62.6 | Invention example |
| 3 | | | | 1.00 | 1.45 | | 535.4 | 7.11 | 62.1 | Invention example |
| 4 | | | | 1.00 | 0.83 | | 610.5 | 7.03 | 61.5 | Comparative example |
| 5 | | | | 0.65 | 0.06 | | 688.2 | 6.87 | 59.4 | Comparative example |
| 6 | | | 40% | 1.54 | 5.55 | | 463.0 | 6.63 | 45.2 | Invention example |
| 7 | | | | 1.19 | 2.65 | | 483.6 | 6.61 | 44.9 | Invention example |
| 8 | | | | 1.00 | 1.32 | | 504.7 | 6.58 | 44.5 | Invention example |
| 9 | | | | 1.00 | 0.87 | | 555.9 | 6.55 | 44.1 | Comparative example |
| 10 | | | | 0.65 | 0.19 | | 628.6 | 6.47 | 43.7 | Comparative example |
| 11 | | Grain | 20% | 2.23 | 41.80 | 105 | 684.5 | 7.21 | 84.9 | Invention example |
| 12 | | size 2 | | 1.47 | 2.21 | | 822.8 | 7.12 | 82.1 | Invention example |
| 13 | | | | 0.84 | 0.54 | | 893.6 | 7.03 | 81.1 | Comparative example |
| 14 | | | | 0.53 | 0.09 | | 978.2 | 6.87 | 78.5 | Comparative example |
| 15 | | | 40% | 2.23 | 12.69 | | 556.5 | 6.71 | 49.7 | Invention example |
| 16 | | | | 1.47 | 1.56 | | 703.1 | 6.65 | 45.4 | Invention example |
| 17 | | | | 0.84 | 0.39 | | 783.5 | 6.60 | 43.1 | Comparative example |
| 18 | | | | 0.53 | 0.01 | | 883.0 | 6.49 | 40.9 | Comparative example |
| 19 | Fe—6.5% Si alloy | Grain | 40% | 1.54 | 5.34 | 65 | 589.6 | 7.18 | 103.9 | Invention example |
| 20 | | size 1 | | 1.19 | 2.28 | | 623.7 | 7.17 | 103.2 | Invention example |
| 21 | | | | 1.00 | 1.28 | | 650.8 | 7.15 | 102.4 | Invention example |
| 22 | | | | 1.00 | 0.95 | | 719.9 | 7.10 | 100.5 | Comparative example |
| 23 | | | | 0.65 | 0.09 | | 796.7 | 7.01 | 99.4 | Comparative example |
| 24 | Fe—Si—B—C system | Grain | 40% | 1.54 | 6.24 | | 902.5 | 6.81 | 25.1 | Invention example |
| 25 | amorphous alloy | size 1 | | 1.19 | 1.87 | | 995.8 | 6.74 | 24.5 | Invention example |
| 26 | | | | 1.00 | 0.88 | | 1099.7 | 6.68 | 22.6 | Comparative example |
| 27 | | | | 0.65 | 0.16 | | 1189.6 | 6.52 | 20.6 | Comparative example |

Formation of Insulation Layer

In the soft magnetic mixed powder obtained, the phosphoric acid-based chemical conversion coating layer and the silicone resin layer were formed in this order as the insulation layer. In forming the phosphoric acid-based chemical conversion coating layer, a treatment liquid obtained by mixing water: 50 parts, $NaH_2PO_4$: 30 parts, $H_3PO_4$: 10 parts, $(NH_2OH)_2H_2SO_4$: 10 parts, and $Co_3(PO_4)_2$: 10 parts, and diluting the same with water by 2,010 times was used as the treatment liquid for the phosphoric acid-based chemical conversion coating layer. More specifically, the treatment liquid was added to the soft magnetic mixed powder with the rate of 50 ml of the treatment liquid per 1 kg of the soft magnetic mixed powder, the mixture was stirred for 5 min or more, was thereafter dried in the air atmosphere at 200° C. for 30 min and was made to pass through a sieve with 300 μm opening, and the phosphoric acid-based chemical conversion coating layer was formed.

In forming the silicone resin layer, a resin solution prepared by dissolving a silicone resin "SR2400" (made by Dow Corning Toray Co., Ltd.) into toluene and having the solid resin content of 5% was used. More specifically, the resin solution was added to the powder formed with the phosphoric acid-based chemical conversion coating layer so that the solid resin content becomes 0.05%, was mixed, and was heated and dried at 75° C. for 30 min in the air atmosphere by an oven furnace, and the silicone resin layer was formed.

Manufacturing of Powder Magnetic Core

The soft magnetic mixed powder in which the insulation layer was formed on the surface thereof was compressively formed using a press machine at 130° C. with the mold lubrication so that the compacting pressure became 1,177 MPa (12 t/cm$^2$), and the powder magnetic core was manufactured. The shape of the compression formed body was made a ring shape of 32 mm outside diameter×28 mm inside diameter×3 mm thickness. The ring-shape compression formed body obtained was subjected to heat treatment under a nitrogen atmosphere at 600° C. for 30 min, and the powder magnetic core was manufactured. Also, the temperature raising rate in heating to 600° C. was made approximately 10° C./min.

Example 1

With respect to the powder magnetic core obtained using the soft magnetic mixed powder of No. 1-No. 27, the density of the formed body is shown in Table 1. Also, the iron loss measured by AC magnetism measurement, the transverse rupture strength measured by the 3 point bending test, and the value of the ($R_{over}/R_{under}$) ratio obtained by converting the grain size distribution measured by the laser diffraction method from the volume fraction into the mass fraction are shown in Table 1. Further, in FIGS. 8-12, the grain size distribution of the soft magnetic mixed powder of No. 6-No. 10 is shown.

As the soft magnetic iron-based alloy powder, the Sendust powder was used in the soft magnetic mixed powder of No. 1-No. 18, Fe-6.5% Si alloy powder was used in the soft magnetic mixed powder of No. 19-No. 23, and the amorphous alloy powder was used in the non-magnetic mixed powder of No. 24-No. 27. In the soft magnetic mixed powder of No. 1-No. 3, No. 6-No. 8, No. 11, No. 15, No. 16, No. 19-No. 21, No. 24, and No. 25, the ($R_{over}/R_{under}$) ratio was 1.2 or more, and the requirement prescribed in the present invention was satisfied. In the soft magnetic mixed powder of No. 4, No. 5, No. 9, No. 10, No. 13, No. 14, No. 17, No. 18, No. 22, and No. 23 other than the soft magnetic mixed powder described above, the ($R_{over}/R_{under}$) ratio was less than 1.2, and the requirement prescribed in the present invention was not satisfied.

Discussion on Example 1

From Table 1, following discussion can be made.

The soft magnetic mixed powder of No. 1-No. 3, No. 6-No. 8, No. 11, No. 12, No. 15, No. 16, No. 19-No. 21, No. 24, and No. 25 is the invention example satisfying the requirement prescribed in the present invention, and all of them exhibited high density of the formed body and low iron loss. Also, as the ($R_{over}/R_{under}$) ratio became larger, the iron loss was reduced more and the density of the formed body improved more. Accompanying improvement of the density of the formed body, the strength of the formed body also improved.

Further, in the soft magnetic mixed powder of No. 24-No. 27, the amorphous alloy powder was used as the soft magnetic iron-based alloy powder. In the soft magnetic mixed powder of No. 24 and No. 25 in which the ($R_{over}/R_{under}$) ratio was 1.2 or more, although the iron loss was reduced, the density of the formed body improved, and the strength of the formed body also improved compared to the soft magnetic mixed powder of No. 26-No. 27, the iron loss had a value larger than that of the case (the soft magnetic mixed powder of No. 1-No. 23) in which Sendust and Fe-6.5% Si alloy powder were used as the soft magnetic iron-based alloy powder. The reason is considered to be that, in stress relieving annealing after compressive forming, crystallization occurred inside the amorphous alloy powder, and the coercive force lowered. In other words, mixing of the amorphous powder that should avoid a high temperature environment and the crystalline powder whose strain cannot be relieved unless heat treatment is executed is not considered to be preferable as a combination of the soft magnetic mixed powder.

On the other hand, the soft magnetic mixed powder of No. 4, No. 5, No. 9, No. 10, No. 13, No. 14, No. 17, No. 18, No. 22, and No. 23 is the comparative example not satisfying the requirement prescribed in the present invention, and the iron loss exhibited a higher value compared to the invention examples of the case where the same soft magnetic iron-based alloy powder was used. Also, the density of the formed body had a low value, and the strength of the formed body also lowered. When the invention examples and the comparison examples were compared to each other, even when the same soft magnetic iron-based alloy powder was used for the soft magnetic iron-based alloy powder, according to the grain size constitution of the pure iron powder and the soft magnetic iron-based alloy powder, the magnetic characteristics and the mechanical characteristics thereof differed. It is known that, by using the pure iron powder and the soft magnetic iron-based alloy powder having a predetermined grain size constitution, the powder magnetic core excellent in formability while reducing the iron loss and having excellent mechanical strength can be obtained.

Example 2

The pure iron powder and the soft magnetic mixed powder No. 28-No. 60 including the pure iron powder and the Sendust powder of 20 mass %, 30 mass % and 40 mass % respectively were manufactured. To the pure iron powder or the soft magnetic mixed powder, the lubricant (ethylenebisamide) was added by the mass rate of 0%-0.6%. The soft magnetic mixed powder added with the lubricant was subjected to powder compaction, the density of the formed body was measured, and the compressibility was evaluated. With respect to the soft magnetic mixed powder No. 28-No. 60, the detail thereof is shown in Table 2-Table 4 along with the measurement result of the density of the formed body.

TABLE 2

| No. | Alloy powder | Rate of alloy powder | Grain size ratio* | $R_{over}/R_{under}$ | D50 (μm) | Rate of lubricant | Impartation of lubricant | Adding means | Density change (g/cm³) | |
|---|---|---|---|---|---|---|---|---|---|---|
| 28 | Fe—9.6%Si—5.5%Al | 20% | 1.30 | 4.09 | 63.1 | 0.0% | Pure iron | Layer | 0.000 | Invention example |
| 29 | alloy (Sendust) | | | | | 0.1% | powder/Alloy | mixing | 0.042 | Invention example |
| 30 | | | | | | 0.2% | powder | | 0.048 | Invention example |
| 31 | | | | | | 0.3% | | | 0.036 | Invention example |
| 32 | | | | | | 0.4% | | | 0.001 | Invention example |
| 33 | | | | | | 0.5% | | | −0.045 | Invention example |
| 34 | | | | | | 0.6% | | | −0.075 | Invention example |
| 35 | | 30% | | 3.47 | 65.6 | 0.0% | | | 0.000 | Invention example |
| 36 | | | | | | 0.1% | | | 0.054 | Invention example |
| 37 | | | | | | 0.2% | | | 0.056 | Invention example |
| 38 | | | | | | 0.3% | | | 0.045 | Invention example |
| 39 | | | | | | 0.4% | | | 0.015 | Invention example |
| 40 | | | | | | 0.5% | | | −0.028 | Invention example |
| 41 | | | | | | 0.6% | | | −0.045 | Invention example |
| 42 | | 40% | | 2.44 | 68.1 | 0.0% | | | 0.000 | Invention example |
| 43 | | | | | | 0.1% | | | 0.080 | Invention example |
| 44 | | | | | | 0.2% | | | 0.068 | Invention example |

TABLE 2-continued

| No. | Alloy powder | Rate of alloy powder | Grain size ratio* | $R_{over}/R_{under}$ | D50 (μm) | Rate of lubricant | Impartation of lubricant | Adding means | Density change (g/cm$^3$) | |
|---|---|---|---|---|---|---|---|---|---|---|
| 45 | | | | | | 0.3% | | | 0.072 | Invention example |
| 46 | | | | | | 0.4% | | | 0.039 | Invention example |
| 47 | | | | | | 0.5% | | | 0.031 | Invention example |
| 48 | | | | | | 0.6% | | | 0.005 | Invention example |

TABLE 3

| No. | Alloy powder | Rate of alloy powder | Grain size ratio* | $R_{over}/R_{under}$ | D50 (μm) | Rate of lubricant | Impartation of lubricant | Adding means | Density (g/cm$^3$) | |
|---|---|---|---|---|---|---|---|---|---|---|
| 49 | — | 0% | — | — | — | — | — | — | 7.454 | Conventional example |
| 50 | | | | | | 0.2% | Pure iron powder | Powder mixing | 7.390 | Conventional example |
| 51 | Fe—9.6%Si—5.5%Al | 30% | 1.30 | 3.47 | 65.6 | — | — | — | 7.016 | Invention example |
| 52 | alloy (Sendust) | | | | | 0.2% | Pure iron powder/Alloy powder | Powder mixing | 7.080 | Invention example |
| 53 | — | 0% | — | — | — | — | — | — | 7.454 | Conventional example |
| 54 | | | | | | 0.2% | Pure iron powder | Layer mixing | 7.417 | Conventional example |
| 55 | Fe—9.6%Si—5.5%Al | 30% | 1.30 | 3.47 | 65.6 | — | — | — | 7.016 | Invention example |
| 56 | alloy (Sendust) | | | | | 0.2% | Pure iron powder/Alloy powder | Layer mixing | 7.073 | Invention example |

TABLE 4

| No. | Alloy powder | Rate of alloy powder | Grain size ratio* | $R_{over}/R_{under}$ | D50 (μm) | Rate of lubricant | Impartation of lubricant | Adding means | Density (g/cm$^3$) | |
|---|---|---|---|---|---|---|---|---|---|---|
| 57 | Fe—9.6%Si—5.5%Al | 30% | 1.30 | 3.47 | 65.6 | 0.2% | Pure iron powder | Powder | 7.048 | Invention example |
| 58 | alloy (Sendust) | | | | | | Alloy powder | mixing | 7.078 | Invention example |
| 59 | | | | | | | Pure iron powder | Layer | 7.055 | Invention example |
| 60 | | | | | | | Alloy powder | mixing | 7.072 | Invention example |

In the soft magnetic mixed powder of No. 28-No. 48, No. 51, No. 52, and No. 55-No. 60, the ratio of the mode of the grain size of the soft magnetic iron-based alloy powder and the pure iron powder (grain size ratio) was 0.9 or more and less than 5, the ($R_{over}/R_{under}$) ratio was 1.2 or more, and the requirement prescribed in the present invention was satisfied.

In the present example, the lubricant was added by two methods. In the soft magnetic mixed powder of No. 28-No. 48, No. 54, No. 56, No. 59, and No. 60, a method of adding the lubricant (ethylenebisamide) into the silicone resin solution in a stage of the insulation coating treatment (layer mixing) was used. Also, in the soft magnetic mixed powder of No. 50, No. 52, No. 57, and No. 58, a method of feeding the powder with the insulation layer and the lubricant (powder) to a V-type mixer for stirring and mixing (powder mixing) was used. Among them, in the soft magnetic mixed powder of No. 50, No. 54, No. 57, and No. 59, the lubricant was imparted only to the pure iron powder, and, in the soft magnetic mixed powder of No. 58 and No. 60, the lubricant was imparted only to the Sendust powder. Also, in the soft magnetic mixed powder of No. 28-No. 48, No. 52, and No. 56, the lubricant was imparted to the powder of the both (the pure iron powder and the Sendust powder) in a mixed state. With respect to the soft magnetic mixed powder in which the lubricant was imparted only to one kind of powder, the Sendust powder and the pure iron powder were subjected to insulation coating treatment individually, the lubricant was imparted by various methods, the Sendust powder and the pure iron powder were thereafter mixed with each other, and the soft magnetic mixed powder was manufactured.

Discussion on Example 2

Figure 13:
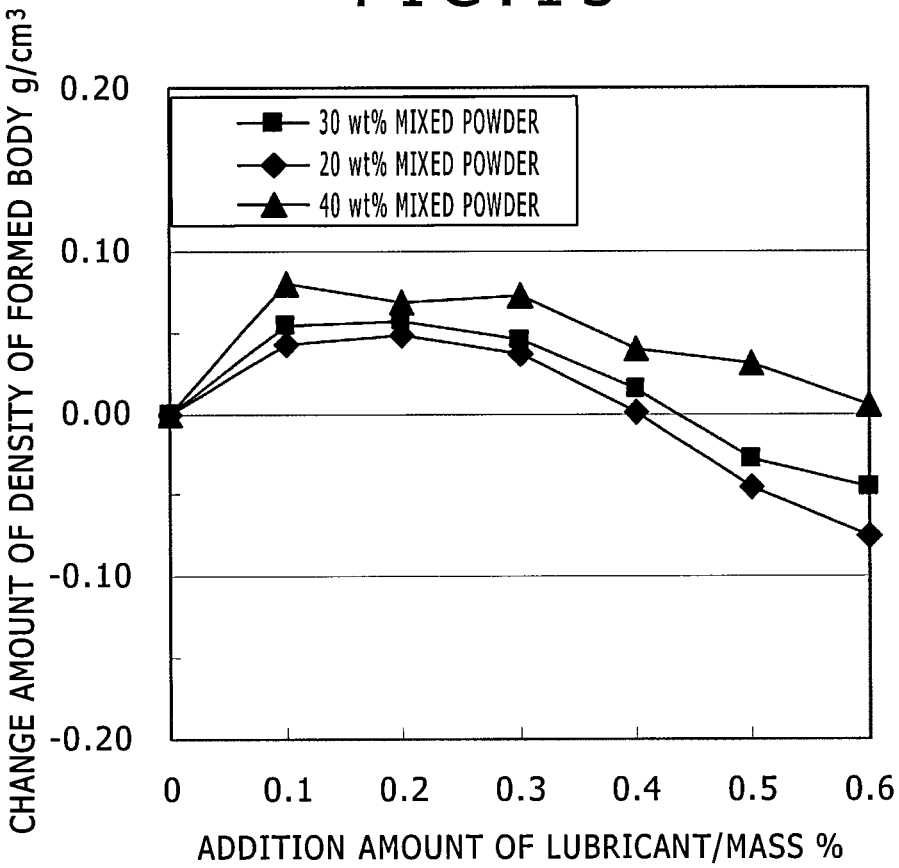
FIG. 13 shows the formed body density of the powder magnetic core obtained using the soft magnetic mixed powder of No. 28-No. 48.

In FIG. 13, the change amount of the density of the formed body of the soft magnetic mixed powder of No. 28-No. 48 was plotted with respect to the addition amount of the lubricant, and it is shown that the compressibility improves by adding the lubricant to the resin layer. The density of the formed body improved by adding the lubricant, and the density of the formed body particularly improved in the range the addition amount of the lubricant was 0.1% or more and 0.3% or less. Also, as the mass rate of the soft magnetic iron-based alloy powder became higher, the compressibility improvement effect by adding the lubricant became more excellent.

Figure 14:
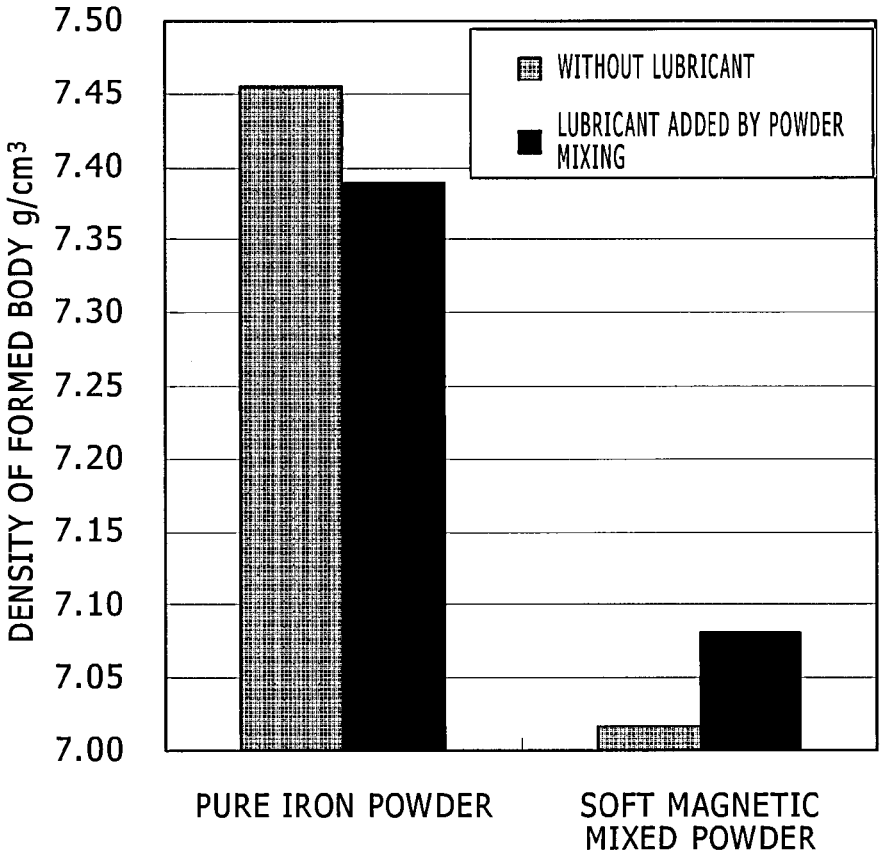
FIG. 14 shows the formed body density of the powder magnetic core obtained using the soft magnetic mixed powder of No. 49-No. 52.
Figure 15:
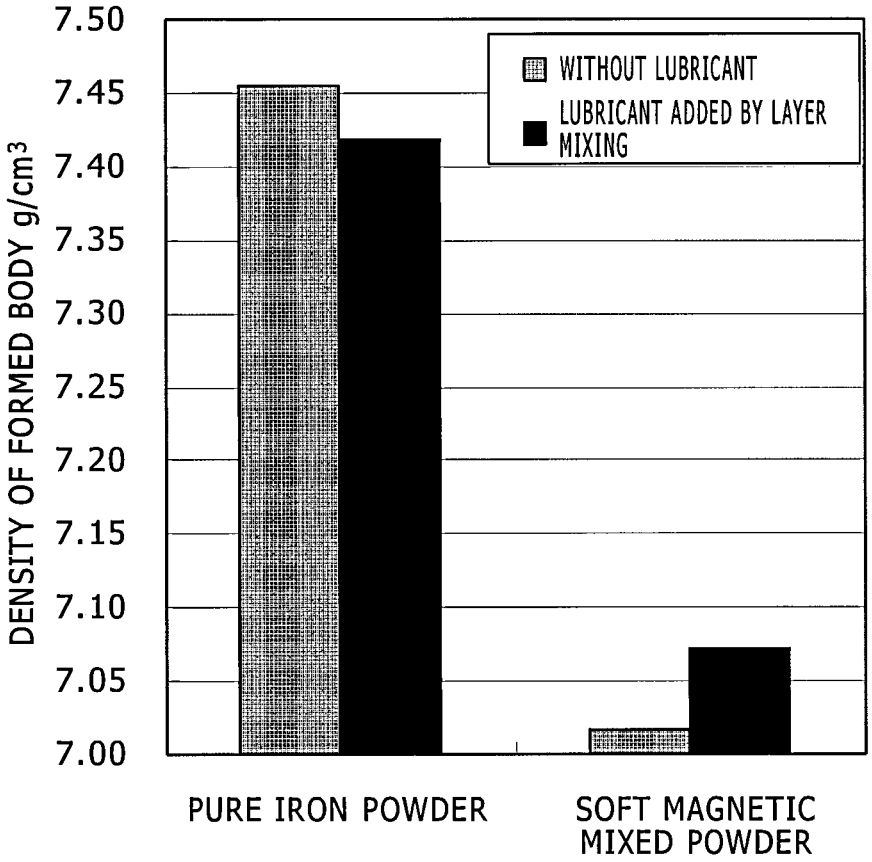
FIG. 15 shows the formed body density of the powder magnetic core obtained using the soft magnetic mixed powder of No. 53-No. 56.

FIG. 14 and FIG. 15 show the change of the compressibility by addition of the lubricant in each of the soft magnetic mixed powder of No. 49-No. 56. FIG. 14 shows a case where the lubricant is added by powder mixing, and FIG. 15 shows a case where the lubricant is added by layer mixing. In both cases, the density lowered by addition of the lubricant in the soft magnetic mixed powder formed of the pure iron powder only, whereas the density improved and the compressibility was improved in the soft magnetic mixed powder of the present invention.

Figure 16:
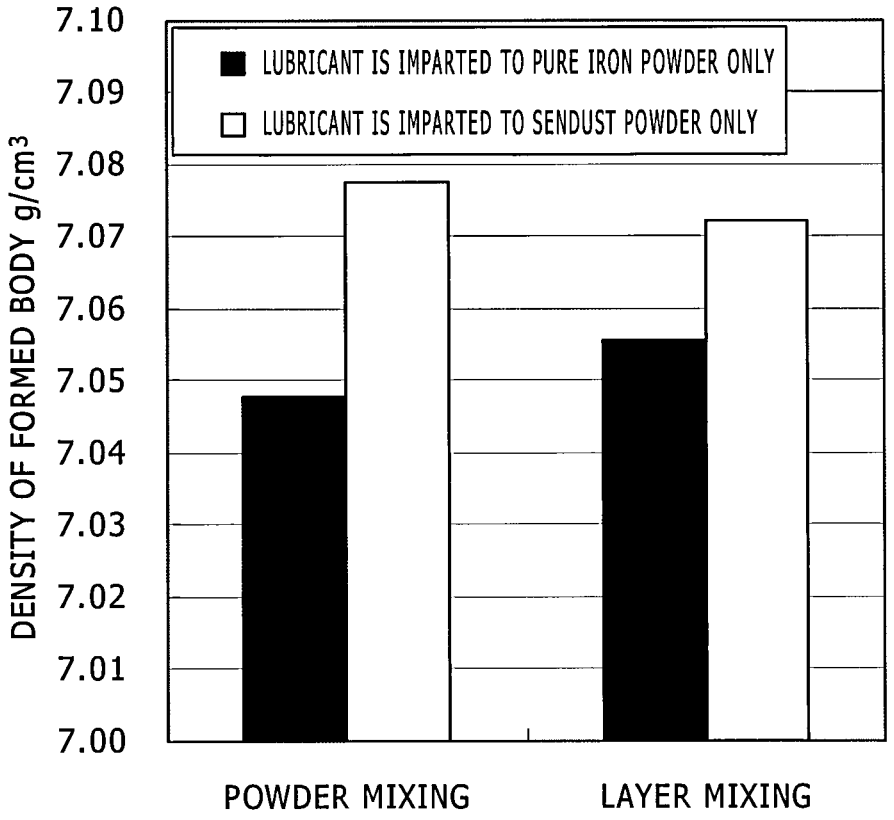
FIG. 16 shows the formed body density of the powder magnetic core obtained using the soft magnetic mixed powder of No. 57-No. 60.

FIG. 16 shows the density of the formed body of the soft magnetic mixed powder of No. 57 and No. 59 in which the lubricant was imparted only to the pure iron powder and the soft magnetic mixed powder of No. 58 and No. 60 in which the lubricant was added only to the pure iron powder in a case where the lubricant was added to the soft magnetic mixed powder at a constant mass rate (0.2%). In both of the soft magnetic mixed powder of No. 57 and No. 58 in which the lubricant was added by the powder mixing and the soft magnetic mixed powder of No. 59 and No. 60 in which the lubricant was added by the layer mixing, the soft magnetic mixed powder in which the lubricant was imparted to the Sendust powder (No. 58 and No. 60) exhibited superior compressibility to the soft magnetic mixed powder in which the lubricant was imparted to the pure iron powder. Thus, in order to obtain such compressibility improvement effect related to the present invention, it is important that the lubricant is imparted at least to the soft magnetic iron-based alloy powder, and it is required either to impart the lubricant to the entire soft magnetic mixed powder, or to impart the lubricant only to the soft magnetic iron-based alloy powder.

As shown in Example 2 of the above, by adding the lubricant to the soft magnetic mixed powder of the present invention, the compressibility of the soft magnetic mixed powder improves further more.

The invention claimed is:

1. A soft magnetic mixed powder, comprising:

soft magnetic iron-based alloy powder; and pure iron powder, wherein the mixing rate of the soft magnetic iron-based alloy powder is 5 mass % or more and 60 mass % or less, the ratio of the mode of the grain size of the soft magnetic iron-based alloy powder and the pure iron powder (the mode of the grain size of the soft magnetic iron-based alloy powder/the mode of the grain size of the pure iron powder) is 0.9 or more and less than 5, and the ratio of the mass rate $R_{over}$ of the soft magnetic iron-based alloy powder in the soft magnetic mixed powder with the grain size of cumulative 50% mass average grain size D50 or more of the soft magnetic mixed powder and the mass rate $R_{under}$ of the soft magnetic iron-based alloy powder in the soft magnetic mixed powder with the grain size of less than the D50 ($R_{over}/R_{under}$) is 1.2 or more.

2. The soft magnetic mixed powder according to claim 1, wherein the cumulative 50% mass average grain size D50 of the soft magnetic mixed powder is 45 μm or more.

3. The soft magnetic mixed powder according to claim 1, wherein the soft magnetic iron-based alloy powder contains Fe and 1 mass % or more and 19 mass % or less of Si.

4. The soft magnetic mixed powder according to claim 1, wherein the soft magnetic iron-based alloy powder further contains 1 mass % or more and 35 mass % or less of Al.

5. The soft magnetic mixed powder according to claim 1, wherein the soft magnetic iron-based alloy powder is either an alloy powder containing Fe, 1 mass % or more and 35 mass % or less of Al, and 1 mass % or more and 19 mass % or less of Si, or an alloy powder containing Fe and 1 mass % or more and 19 mass % or less of Si.

6. The soft magnetic mixed powder according to claim 1, wherein the soft magnetic mixed powder has an insulation layer.

7. The soft magnetic mixed powder according to claim 6, wherein lubricant formed of organic substance is provided on the surface or in the insulation layer of the soft magnetic mixed powder.

8. The soft magnetic mixed powder according to claim 6, wherein lubricant formed of organic substance is provided on the surface or in the insulation layer at least of the soft magnetic iron-based alloy powder.

9. The soft magnetic mixed powder according to claim 5, wherein the soft magnetic iron-based alloy powder has an insulation layer, and lubricant formed of organic substance is provided on the surface and/or in the insulation layer of the soft magnetic iron-based alloy powder.

10. The soft magnetic mixed powder according to claim 7, wherein the mass rate of the lubricant is 0.1 mass % or more and 0.6 mass % or less relative to 100 mass % of the soft magnetic mixed powder.

11. A powder magnetic core obtained by using the soft magnetic mixed powder according to claim 1.

* * * * *